US009675189B2

(12) United States Patent
Jensen et al.

(10) Patent No.: US 9,675,189 B2
(45) Date of Patent: Jun. 13, 2017

(54) COVER ASSEMBLIES FOR MATTRESSES

(71) Applicants: Ida T. Jensen, København N. (DK); Elger Oberwelz, San Francisco, CA (US); Thomas D. C. Overthun, San Francisco, CA (US); Martin Schnitzer, San Francisco, CA (US); Kara W. Johnson, San Francisco, CA (US)

(72) Inventors: Ida T. Jensen, København N. (DK); Elger Oberwelz, San Francisco, CA (US); Thomas D. C. Overthun, San Francisco, CA (US); Martin Schnitzer, San Francisco, CA (US); Kara W. Johnson, San Francisco, CA (US)

(73) Assignee: Tempur-Pedic Management, LLC, Lexington, KY (US)

( * ) Notice: Subject to any disclaimer, the term of this patent is extended or adjusted under 35 U.S.C. 154(b) by 0 days.

(21) Appl. No.: 14/145,876

(22) Filed: Dec. 31, 2013

(65) Prior Publication Data

US 2015/0182042 A1 Jul. 2, 2015

(51) Int. Cl.
*A47G 9/04* (2006.01)
*G09F 3/04* (2006.01)
(Continued)

(52) U.S. Cl.
CPC ..... *A47G 9/04* (2013.01); *A47C 21/06* (2013.01); *A47C 27/006* (2013.01);
(Continued)

(58) Field of Classification Search
CPC ..... A47C 31/10; A47C 31/105; A47C 27/001; A47C 27/005; A47C 27/081; A47G 9/02;
(Continued)

(56) References Cited

U.S. PATENT DOCUMENTS 2,610,336 A 9/1952 Schworm, Jr.
2,748,399 A * 6/1956 Rockoff ..... A47C 27/081 297/DIG. 1

(Continued)

FOREIGN PATENT DOCUMENTS

JP 3047366 U 4/2008

OTHER PUBLICATIONS

International Searching Authority; Notification of Transmittal of the International Search Report and the Written Opinion of the International Searching Authority, or the Declaration; Apr. 10, 2015, 17 pgs.

(Continued)

*Primary Examiner* — Robert G Santos
*Assistant Examiner* — Myles Throop

(57) ABSTRACT

A cover assembly for a mattress is provided that includes a first cover and a second cover. The first cover includes a top panel, a bottom panel, and a continuous side panel collectively defining a cavity for enclosing the mattress. The second cover includes a top surface and a bottom surface, with the second cover being positioned over and dimensionally-sized to cover at least the top panel of the first cover. A fastener then connects the second cover to the first cover along the perimeter of the second cover. Methods for marking a mattress are also provided that include the step of marking an indicia indicative of a characteristic of a mattress on the top surface of the second cover of the cover assembly.

33 Claims, 19 Drawing Sheets

(51) Int. Cl.

| | |
|---|---|
| ***A47C 27/08*** | (2006.01) |
| ***A47G 9/10*** | (2006.01) |
| ***A47G 9/02*** | (2006.01) |
| ***A47C 21/06*** | (2006.01) |
| ***A47C 27/00*** | (2006.01) |
| ***A47C 27/14*** | (2006.01) |
| ***A47C 27/15*** | (2006.01) |
| ***A47C 31/10*** | (2006.01) |
| *G09F 3/02* | (2006.01) |

(52) U.S. Cl.
CPC ..... *A47C 27/008* (2013.01); *A47C 27/081* (2013.01); *A47C 27/148* (2013.01); *A47C 27/15* (2013.01); *A47C 31/105* (2013.01); *A47G 9/0238* (2013.01); *A47G 9/0246* (2013.01); *A47G 9/10* (2013.01); *G09F 3/04* (2013.01); *G09F 2003/0282* (2013.01)

(58) Field of Classification Search
CPC ..... A47G 9/04; A47G 9/0238; A47G 9/0261; A47G 9/10; G09F 3/04; G09F 2003/0282
USPC ..... 5/490, 737–738
See application file for complete search history.

(56) References Cited

U.S. PATENT DOCUMENTS 3,530,487 A * 9/1970 Beer ..... 5/496
3,613,133 A * 10/1971 Isola ..... A47G 9/02 428/690
4,301,561 A * 11/1981 McLeod ..... 5/496
4,388,738 A 6/1983 Wagner
4,809,375 A 3/1989 Bull
5,086,530 A 2/1992 Blake
5,136,741 A 8/1992 Balonick et al.
5,655,236 A * 8/1997 Murray ..... G09F 23/00 5/482
6,216,292 B1 4/2001 Oakhill et al.
D456,660 S 5/2002 Landvik
6,541,094 B1 4/2003 Landvik et al.
6,578,218 B2 6/2003 Wassilefsky
6,602,579 B2 8/2003 Landvik et al.
6,631,529 B1 * 10/2003 Erickson ..... 5/738
6,651,278 B2 11/2003 Ghanem
6,859,962 B2 * 3/2005 Diak/Ghanem ..... 5/499
6,866,915 B2 3/2005 Landvik
7,007,325 B1 * 3/2006 Gomeh ..... 5/496
7,051,389 B2 5/2006 Wassilefsky
7,082,633 B1 8/2006 Maarbjerg
D529,325 S 10/2006 Maarbjerg
7,155,765 B2 1/2007 Fogg
D558,499 S 1/2008 Maarbjerg
7,370,380 B2 5/2008 DeFranks et al.
7,415,742 B2 8/2008 Wassilefsky
7,444,702 B2 11/2008 Fogg
7,469,437 B2 12/2008 Mikkelsen et al.
7,487,560 B2 2/2009 McGrath et al.
7,507,468 B2 3/2009 Landvik et al.
7,555,615 B2 6/2009 Landvik
7,587,775 B2 9/2009 DeFranks et al.
7,707,670 B2 5/2010 Fogg
7,735,169 B2 6/2010 Wassilefsky
7,979,374 B2 7/2011 Landvik
8,025,964 B2 9/2011 Landvik et al.
8,034,445 B2 10/2011 Landvik et al.
8,181,293 B2 * 5/2012 DeFranks et al. ..... 5/691
D726,452 S * 4/2015 Jensen ..... D6/606
2001/0021438 A1 9/2001 Landvik
2003/0118795 A1 * 6/2003 Wright ..... A47C 27/00 428/195.1
2003/0171954 A1 9/2003 Guerin et al.
2004/0033351 A1 2/2004 Landvik et al.
2004/0073931 A1 4/2004 Trussel, Jr. et al.
2005/0076446 A1 4/2005 Fogg
2005/0084667 A1 4/2005 Landvik et al.
2005/0202214 A1 9/2005 Landvik
2005/0210595 A1 9/2005 Di Stasio et al.
2006/0174414 A1 8/2006 Maarbjerg
2006/0277684 A1 12/2006 Wassilefsky
2006/0288490 A1 12/2006 Mikkelsen et al.
2007/0022540 A1 2/2007 Hochschild
2007/0067916 A1 * 3/2007 Poston ..... 5/691
2007/0094803 A1 5/2007 Fogg
2007/0113352 A1 * 5/2007 Poulos ..... 5/727
2008/0005845 A1 * 1/2008 Moran Pfleger ..... 5/691
2008/0016619 A1 1/2008 Chuang
2008/0098533 A1 * 5/2008 Erdman ..... A47C 31/105 5/722
2009/0056030 A1 * 3/2009 Bolden ..... 5/713
2009/0171774 A1 7/2009 Stagner et al.
2011/0252562 A1 10/2011 Mikkelsen et al.
2011/0256380 A1 * 10/2011 Chandler ..... A47C 27/085 428/316.6
2012/0102646 A1 * 5/2012 Chen et al. ..... 5/499
2012/0227185 A1 * 9/2012 Batiste et al. ..... 5/641
2013/0139316 A1 6/2013 Rabbany et al.
2013/0219618 A1 * 8/2013 Rotter ..... 5/502
2014/0208518 A1 * 7/2014 Corodemus et al. ..... 5/691
2014/0259408 A1 * 9/2014 Morley ..... 5/502
2015/0060320 A1 * 3/2015 Mitchell ..... C09J 5/00 206/459.5
2015/0182042 A1 7/2015 Jensen
2015/0187233 A1 7/2015 Jensen

OTHER PUBLICATIONS

Korean Intellectual Property Office, International Search Report issued in corresponding Application No. PCT/US2014/072647, mailed Apr. 17, 2015.
Korean Intellectual Property Office, International Search Report issued in corresponding Application No. PCT/US2014/072635, mailed Apr. 24, 2015.
Korean Intellectual Property Office, International Preliminary Report on Patentability issued in corresponding Application No. PCT/US2014/072635, mailed Jul. 5, 2016.

* cited by examiner

COVER ASSEMBLIES FOR MATTRESSES

TECHNICAL FIELD

The present invention relates to cover assemblies for mattresses. In particular, the present invention relates to cover assemblies for mattresses that make use of a first cover for enclosing the mattress and a second cover for covering at least a top panel of the first cover.

BACKGROUND

To protect a mattress and prevent it from becoming stained, torn, or otherwise damaged, mattresses are often surrounded by a mattress cover that completely covers the top, sides, and the bottom of the mattress. In most mattress covers, a zipper or other similar fastener is used to enclose the mattress cover on a single side or around a bottom portion of the mattress. Such mattress covers are often sufficient for protecting a mattress. However, in the event that the mattress cover does become stained, torn, or otherwise damaged, it may be exceedingly difficult to remove the mattress cover from the mattress and then replace it with a new or clean mattress cover. Additionally, mattress covers are almost always made from protective materials, such as plastics and coarse fabrics that prevent the underlying mattresses from becoming stained, torn, or otherwise damaged, but that can be irritating or uncomfortable to the skin of a user that comes into contact with such a mattress cover.

In this regard, mattress covers are often covered with a fitted sheet that completely covers the top of the mattress cover, the sides of the mattress cover, and a small portion of the bottom edge of the mattress cover (as a result of a lower edge of the fitted sheet being tucked under the mattress). Those fitted sheets typically provide a softer surface on which to rest the body of a user, and also typically provide a layer of material that can easily be removed and then cleaned or replaced should the fitted sheet become stained, torn, or otherwise damaged. Nevertheless, it is often the ease that fitted sheets slip off of the mattress cover and the underlying mattress, and can thus potentially fail to provide a sufficient additional layer. Moreover, such fitted sheets are often made from materials that ultimately fail to protect the underlying mattress cover as any staining or damage to the fitted sheet will also typically affect the mattress cover. Accordingly, a cover assembly that can be securely fastened to a mattress, or other support cushion, and provide a more sufficient layer of protection and functionality would be both highly desirable and beneficial.

SUMMARY

The present invention includes cover assemblies for mattresses. In particular, the present invention includes cover assemblies for mattresses that make use of a first cover for enclosing a mattress and a second cover for covering at least a top panel of the first cover.

In one exemplary embodiment of the present invention, a cover assembly for a mattress is provided that includes a first cover having a top panel, a bottom panel, and a continuous side panel, with the panels collectively defining a cavity for enclosing the mattress. The continuous side panel of the first cover can be further characterized as including a head panel, a foot panel, and two opposing side panels. The cover assembly further includes a second cover having a top surface and a bottom surface, with the second cover defining a perimeter. A fastener connects the second cover to the first cover along the perimeter of the second cover.

The second cover of the cover assembly is generally positioned over the top panel of the first cover and is dimensionally-sized to cover at least the top panel. For example, in certain embodiments, the second cover is dimensionally-sized to cover the top panel and an upper half of each opposing side panel. In other embodiments, the second cover is dimensionally-sized to cover the top panel, an upper half of each opposing side panel, an upper edge of the foot panel, and an upper edge of the head panel. In even further embodiments, the second cover is dimensionally-sized to cover the top panel, an upper half of each opposing side panel, an upper half of the foot panel, and an upper half of the head panel.

Regardless of the particular size and arrangement of the second cover, the fastener connecting the second cover to the first cover is generally comprised of one or more zippers that extend around the perimeter of the second cover. In some embodiments, the zipper is a two-way separating zipper having two slider bodies extending around a single track to provide a fastener in which the zipper slider bodies and the zipper pulls can be located anywhere along the length of the track, such that the point of opening for the zipper can also be anywhere along the length of the track. In other embodiments, there are four separate zippers extending around the perimeter of the second cover, with one zipper extending along the head panel of the first cover, one zipper extending along the foot panel of the first cover, and one zipper extending along each side panel of the first cover. By incorporating such zippers into a cover assembly of the present invention, the second cover can thus easily be removed from the first cover by simply unzipping the one or more zippers and disconnecting the second cover from the first cover. The second cover can then be easily cleaned or replaced as desired.

To provide a second cover that can easily be cleaned upon being removed from the first cover, the second cover is also typically comprised of a textile that is sufficiently durable, but yet is machine-washable and easily cared for, such that the second cover can be removed from the first cover, cleaned, and then reconnected to the first cover. To further take advantage of the configuration of the second cover relative to the first cover of the cover assembly, however, one or more additional materials can also be incorporated into the first cover, the second cover, or both the first cover and the second cover of the cover assembly to provide an additional level of protection to the first cover and the underlying mattress enclosed by the first cover. For example, in some embodiments, the bottom surface of the second cover can include a water-impervious and vapor-permeable material that prevents liquids or other moisture from traveling from the second cover to the first cover and the underlying mattress, but that also allows any liquid or moisture in the first cover or underlying mattress to evaporate and travel through the second cover. As yet another example, in some embodiments, an exemplary cover assembly also preferably incorporates one or more flame-retardant materials into the first cover, the second cover, or both.

With further respect to the configuration of the cover assemblies of the present invention, in some embodiments, cover assemblies are provided that also include additional features designed to increase the comfort of a user lying on the cover assembly. For instance, in some embodiments, the second cover includes an amount of phase change material that is included in the second cover and is configured to provide cooling at the top surface of the second cover.

Additionally, in some embodiments, the second cover includes an amount of a flexible foam positioned between the top surface and the bottom surface, such that the second cover can be used as an overlay to a mattress, or other support cushion, and provide an increased level of comfort. Moreover, in some embodiments, a charcoal sheet can be incorporated into the first cover, the second cover, or both the first cover and the second cover to eliminate or mitigate the presence of any odors or chemicals present in the cover assembly or the underlying mattress.

As an additional refinement to the cover assemblies of the present invention, in some embodiments, cover assemblies are provided in which the first cover, the second cover, or both the first cover and the second cover includes an indicia that is indicative of a characteristic of the mattress. By including such indicia on the first cover, the second cover, or both the first cover and the second cover, a user is able to visually identify a characteristic of a mattress, such as the firmness of the mattress or the type of the mattress. Further, in embodiments in which the cover assemblies of the present invention are used to cover a mattress comprised of a visco-elastic foam, the indicia can be used to not only identify the mattress as a visco-elastic foam-type of mattress, but can further be used to identify a characteristic of the visco-elastic foam, such as a density or hardness of the visco-elastic foam, or the number of layers of visco-elastic foam that are included in the mattress.

The indicia on the cover assemblies of the present invention can include patterns, colors, or combinations of patterns and colors, and can be positioned at a variety of different locations on the first and second cover. For instance, in some embodiments, the indicia is a pattern positioned on the top surface of the second cover. In other embodiments, the indicia comprises a plurality of geometric shapes embossed or debossed into or otherwise positioned on the end panel of the first cover, the side panels of the first cover, or both the end panel and side panels of the first cover.

In some embodiments, the indicia is a dot that is positioned on the top surface of the second cover and that has a color. In such embodiments, the end panel of the first cover has a color substantially identical to the color of the dot, such that both the second cover and the first cover include substantially the same indicia indicative of a characteristic of the mattress. In some embodiments, the indicia can be used as part of an overall bed assembly in which each of the components of the bed assembly or a select group of components include the indicia, such that the bed assembly not only includes the indicia on the cover assembly to indicate a characteristic of the mattress, but the additional components of the bed assembly (e.g., the foundation and the pillows) can also include the same indicia and indicate the characteristic of the mattress. In this regard, in certain embodiments, the cover and bed assemblies of the present invention can be used as an overall system in which multiple components of the bed assembly are marked with an indicia to allow for visual identification of a characteristic of a mattress.

With further respect to the cover assemblies of the present invention, an exemplary cover assembly can also be used as part of a method for marking a mattress to allow for visual identification of a characteristic of a mattress. In some implementations, a method for marking a mattress to allow for visual identification of a characteristic of the mattress includes first providing a mattress cover assembly having a first cover for enclosing a mattress and a second cover positioned over and dimensionally-sized to cover at least the top panel of the first cover. The top surface of the second cover is then marked with a first indicia that is indicative of a first characteristic of the mattress and that allows a user to visually identify a characteristic of the mattress by simply observing the mattress and associating the indicia with the characteristic (e.g., the firmness or type of the mattress). In some implementations, a second indicia can also be marked on the foot panel of the first cover, the two opposing side panels, or both the foot panel and the two opposing side panels, where the second indicia is indicative of either the first characteristic of the mattress or is indicative of a second characteristic of the mattress. For instance, in some implementations, both the first indicia and the second indicia are substantially the same color and are used to indicate that the mattress has a particular firmness. Alternatively, in other implementations, the first indicia is a pattern placed on the first cover and is used to indicate that the mattress is a visco-elastic foam mattress, while the second indicia is comprised of multiple rows of geometric shapes positioned on the end panel of the first cover and is used to indicate the number or types of layers of visco-elastic foam included in that particular visco-elastic foam mattress.

As an even further addition to the cover and bed assemblies described herein, in some embodiments, an exemplary bed assembly is provided that includes an alignment system for aligning a mattress assembly (e.g., a mattress assembly incorporating a cover assembly of the present invention) on a foundation. The exemplary bed assembly includes a foundation and a mattress having a first surface, a second surface opposite the first surface, and opposing sides. A first alignment member is attached to the head portion of the second surface of the mattress, while a second alignment member is attached to the foot portion of the second surface of the mattress.

Both the first alignment member and the second alignment member of the alignment system include two curved ends and an elongated center segment having a length sufficient to span a width of the mattress. In this regard, when the first and second alignment members are placed on the second surface of the mattress, the curved ends of the alignment members extend from the second surface of the mattress and around a particular side of the mattress. Four brackets are then used to secure the alignment members to the foundation, with the first bracket engaging the first of the two curved ends of the first alignment member, the second bracket engaging the second of the two curved ends of the first alignment member, the third bracket engaging the first of the two curved ends of the second alignment member, and the fourth bracket engaging the second of the two curved ends of the second alignment member.

To secure the alignment members to the brackets and, consequently, the mattress to the foundation of the bed assembly, the elongated center segment of each alignment member defines a first opening adjacent to the first of the two curved ends and a second opening adjacent to the second of the two curved ends. Both the first and second opening are generally in the form of an elongated channel that extends in a direction perpendicular to the longitudinal axis of the alignment member. In this regard, the first bracket and the second bracket each include a protuberance in the shape of a ridge that is configured and positioned such that, upon each bracket engaging a particular curved end of the alignment member, the ridge extends into a particular channel on the elongated center segment and secures each bracket to the alignment member to thereby align the mattress on the foundation.

Further features and advantages of the present invention will become evident to those of ordinary skill in the art after a study of the description, figures, and non-limiting examples in this document.

DESCRIPTION OF EXEMPLARY EMBODIMENTS

The present invention includes cover assemblies for mattresses. In particular, the present invention includes cover assemblies, that include a first cover for enclosing a mattress and a second cover for covering at least a top panel of the first cover.

Figure 6:
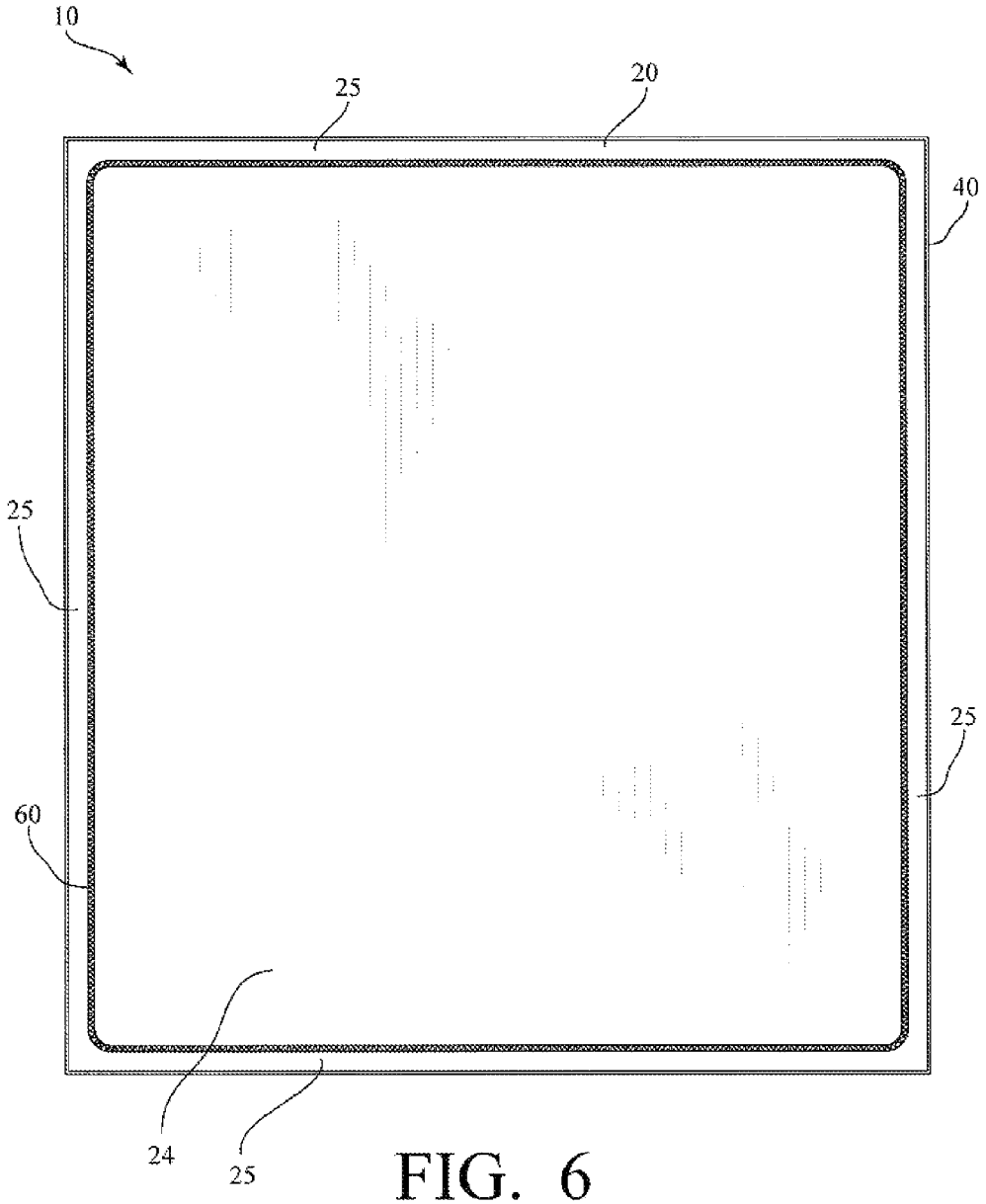
FIG. 6 is bottom view of the cover assembly of FIG. 1.

Referring first to FIGS. 1-6, in one exemplary embodiment of the present invention, a cover assembly 10 for a mattress is provided that includes a first cover 20 having a top panel 22, a bottom panel 24, and a continuous side panel 30. The continuous side panel 30 of the first cover 20 can be characterized as including a head panel 32, a foot panel 34, and two opposing side panels 36, 38 that, with the top panel 22 and bottom panel 24, collectively define a cavity for enclosing a mattress. The first cover 20 further includes a brand tag 62 extending vertically along a portion of the foot panel 34. Also included on the first cover 20 is a zipper 60 that extends around a periphery 25 of the bottom panel 24 and is used to secure the first cover 20 around a mattress, as best shown in FIG. 6.

Figure 1:
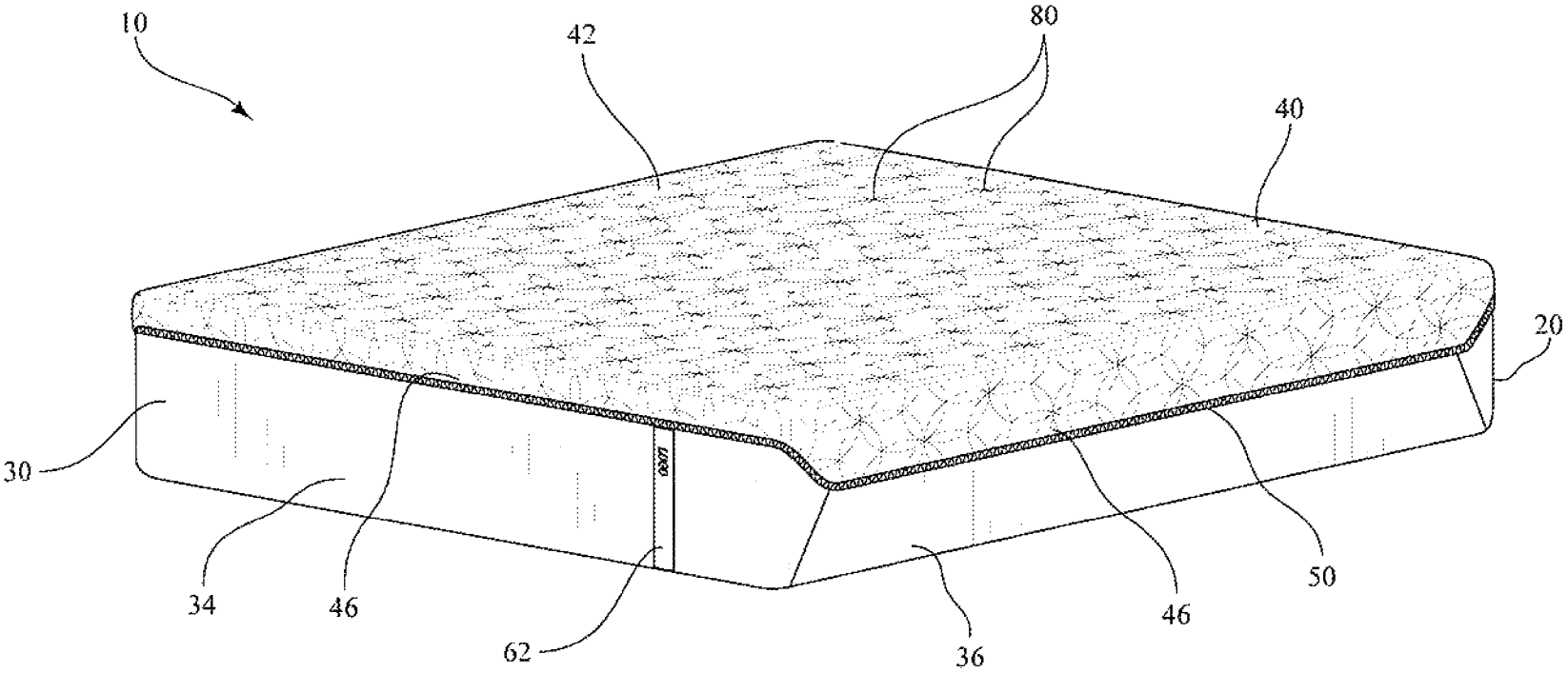
FIG. 1 is a perspective view of an exemplary cover assembly made in accordance with the present invention.
Figure 2:
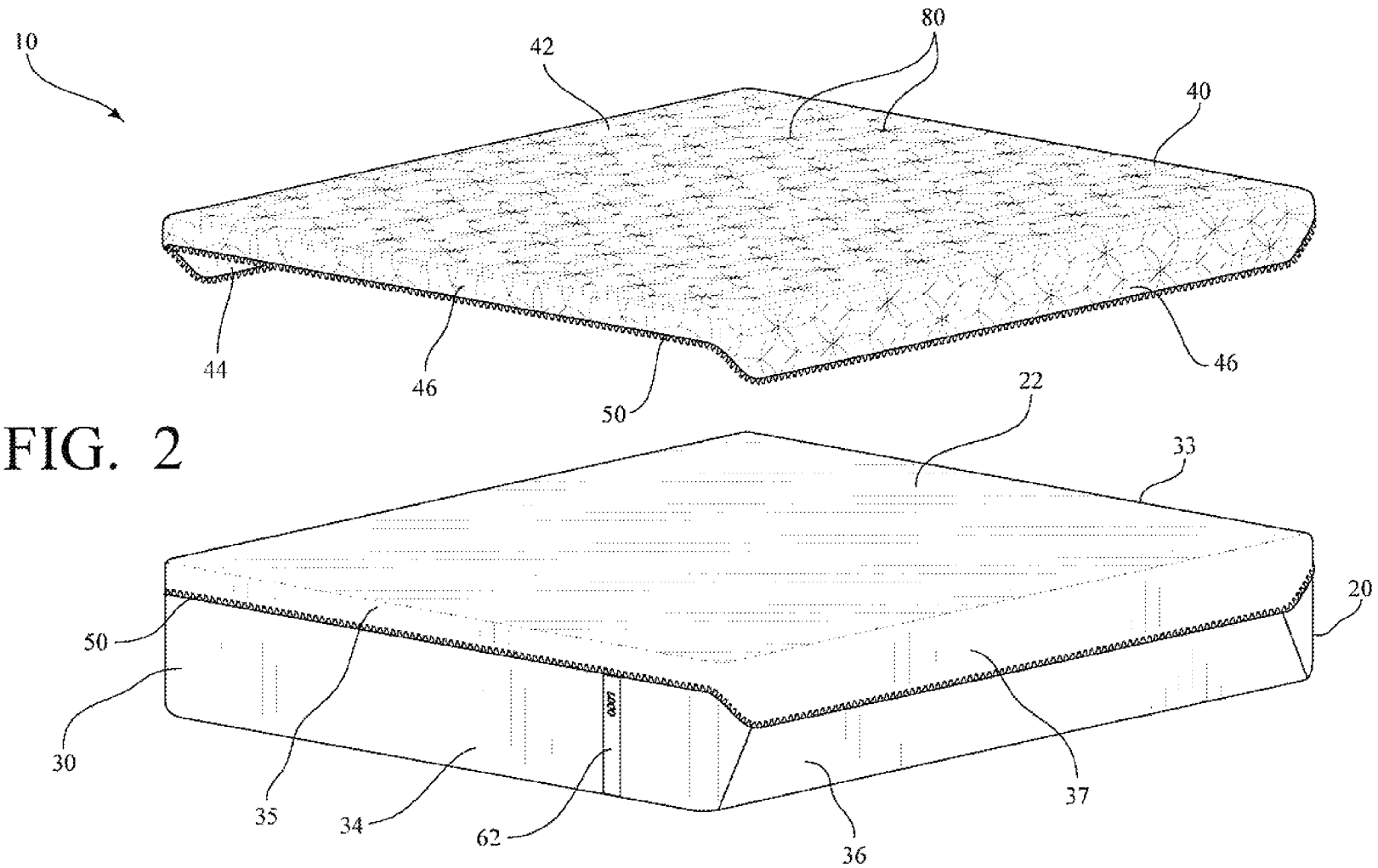
FIG. 2 is an exploded perspective view of the exemplary cover assembly of FIG. 1, showing the second cover removed from the top surface of the first cover.
Figure 3:
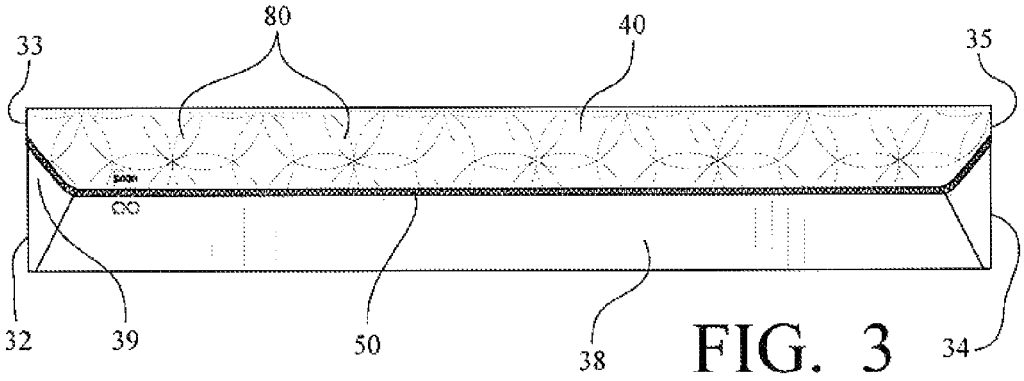
FIG. 3 is a right side elevational view of the cover assembly of FIG. 1.

The cover assembly 10 further includes a second cover 40 having a top surface 42 and a bottom surface 44, with the second cover 40 also defining a perimeter 46. The second cover 40 of the cover assembly 10 is generally positioned over the top panel 22 of the first cover 20 and is dimensionally-sized to cover at least the top panel 22 of the first cover 20, the area of which is indicated by the hatching that is shown in FIG. 2 and that designates a blue color for the top panel 22 of the first cover 20. In particular, in the cover assembly 10, the second cover 40 is dimensionally-sized to cover the top panel 22, the upper halves 37, 39 of each opposing side panel 36, 38, an upper edge 35 of the foot panel 34, and an upper edge 33 of the head panel 32. By including such a second cover 40 in the cover assembly 10, the second cover 40 is thus configured to cover and protect the portions of the underlying first cover 20 and, consequently, the portions of any mattress underlying the first cover 20, that would be exposed to excessive wear and would be at an increased risk of becoming stained or damaged, namely the top panel 22, the upper halves 37, 39 of each opposing side panel 36, 38, the upper edge 35 of the foot panel 34, and the upper edge 33 of the head panel 32. Further, by including such a second cover 40 in the cover assembly 10, the second cover 40 causes the upper halves 37, 39 of each opposing side panel 36, 38 to assume a more rounded configuration upon attachment of the second cover 40 to the first cover 20. Of course, and as described in further detail below, numerous other sizes and configurations for the second cover 40 can also be readily selected as desired and can be incorporated into a particular cover assembly to prevent damage or staining to a mattress or to alter the appearance of an a mattress without departing from the spirit and scope of the subject matter described herein.

Figure 4:
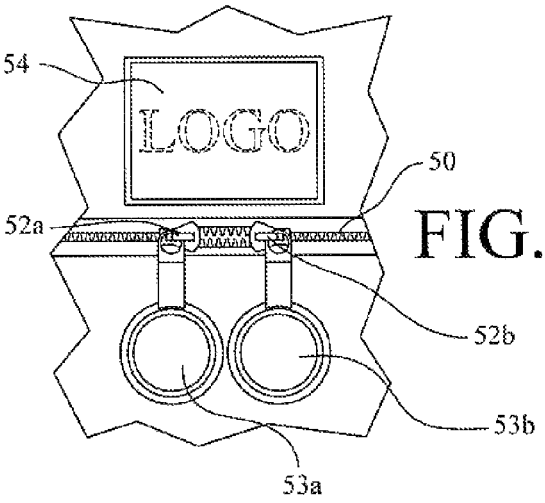
FIG. 4 is a partial, enlarged right side elevational view of the cover assembly of FIG.
Figure 5:
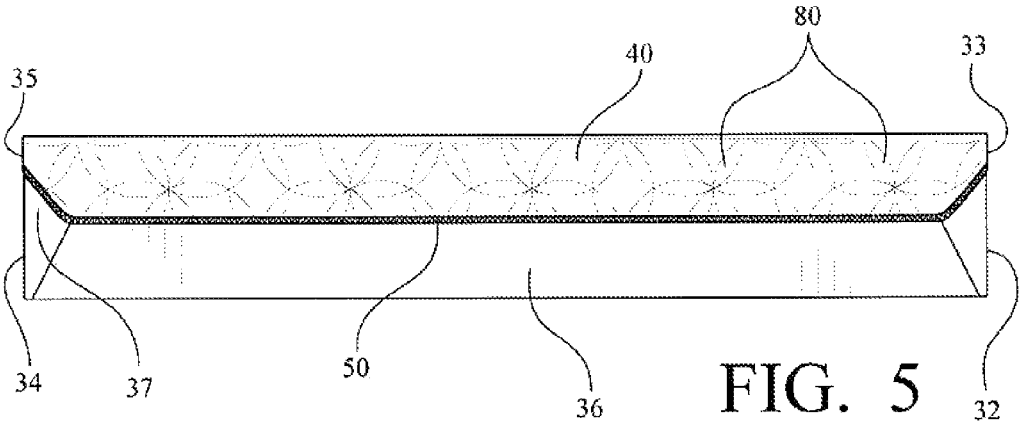
FIG. 5 is left side elevational view of the cover assembly of FIG. 1.

Referring still to FIGS. 1-6, the cover assembly 10 further includes a fastener in the form of a two-way separating zipper 50 that connects the second cover 40 to the first cover 20 along the perimeter 46 of the second cover 40. As best shown in FIG. 4, the two-way separating zipper 50 includes two slider bodies 52*a*, 52*b* that are each connected to a zipper pull 53*a*, 53*b*. The zipper pulls 53*a*, 53*b* preferably have an increased size relative to other zipper pulls used for traditional mattress covers to allow the slider bodies 52*a*, 52*b* to be easily moved along the perimeter 46 of the second cover 40. The slider bodies 52*a*, 52*b* are also each connected to the track of the two-way separating zipper 50, such that the slider bodies 52*a*. 52*b* can slide around the track of the zipper 50 and can be used to separate the second cover 40 from the first cover 20 at any desired position along the length of the two-way separating zipper 50. In this regard, by incorporating such a two-way separating zipper 50 into the cover assembly 10, not only can the second cover 40 be easily removed from the first cover 20 by simply moving the zipper pulls 53*a*, 53*b* and slider bodies 52*a*, 52*b* in opposite directions and unzipping the second cover 40 from the first cover 20 (e.g., to clean or replace the second cover 40), but the second cover 40 can also be easily reattached to the first cover 20.

Further, by making use of a two-way separating zipper 50, the slider bodies 52*a*, 52*b* and zipper pulls 53*a*, 53*b* can be positioned on the two-way separating zipper 50, such that the slider bodies 52*a*, 52*b* and zipper pulls 53*a*, 53*b* can be hidden from sight when not in use or can be positioned along the perimeter 46 of the second cover 40 where the risk of the slider bodies 52*a*, 52*b* and zipper pulls 53*a*, 53*b* causing damage to the cover assembly 10, or any underlying mattress, is minimized. For example, the slider bodies 52*a*, 52*b* could be positioned adjacent to a panel of reinforcing fabric 54 on the perimeter 46 of the second cover 40, as shown best in FIG. 4. The panel of reinforcing fabric 54 helps to protect the second cover 40 when a user grabs one or both of the zipper pulls 53*a*, 53*b* and begins to move the slider bodies 52*a*, 52*b* along the track of the zipper 50, but yet also helps to identify the location of the slider bodies 52*a*, 52*b* and zipper pulls 53*a*, 53*b*.

Figure 7:
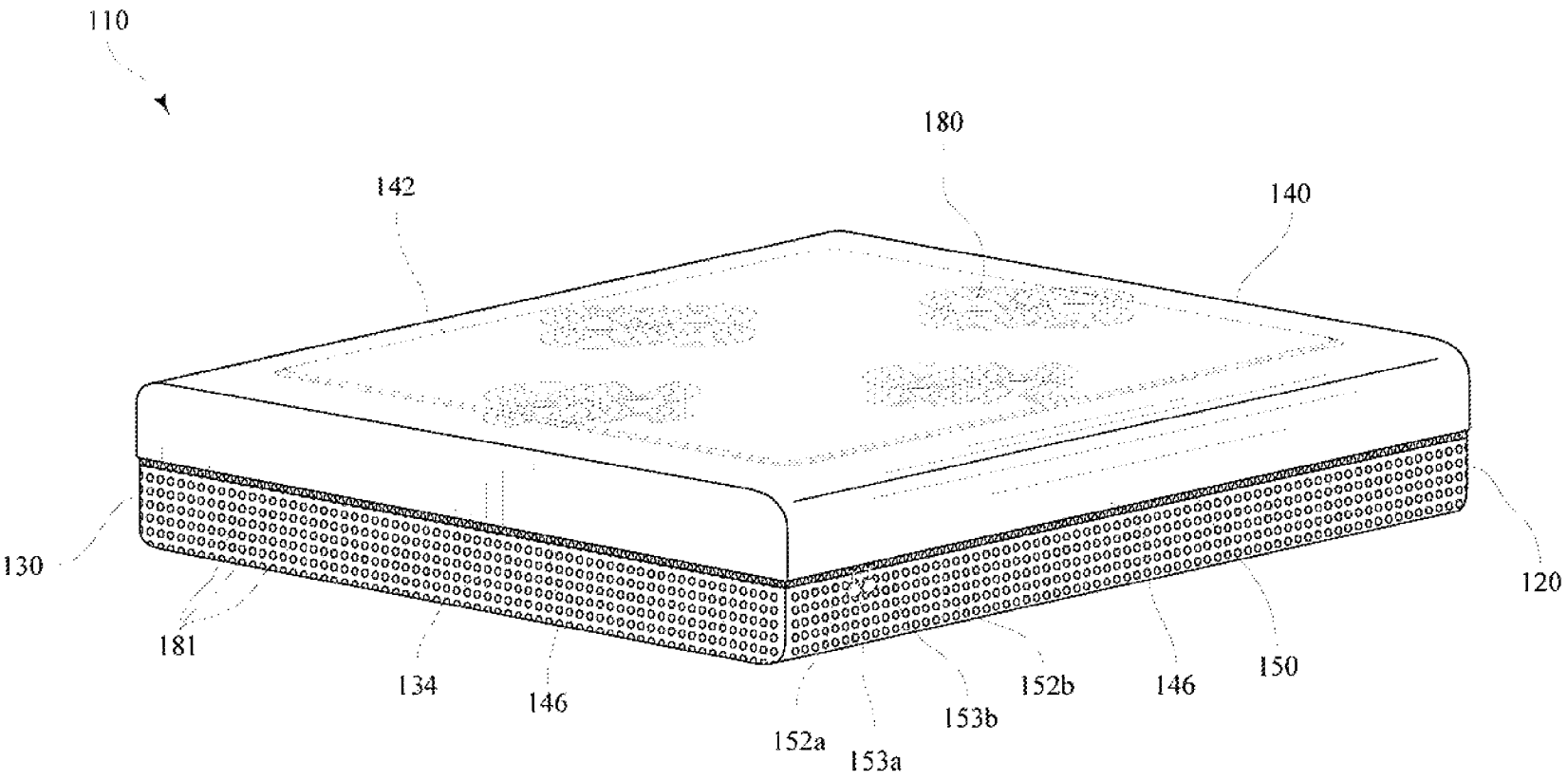
FIG. 7 is a perspective view of another exemplary cover assembly made in accordance with the present invention.
Figure 8:
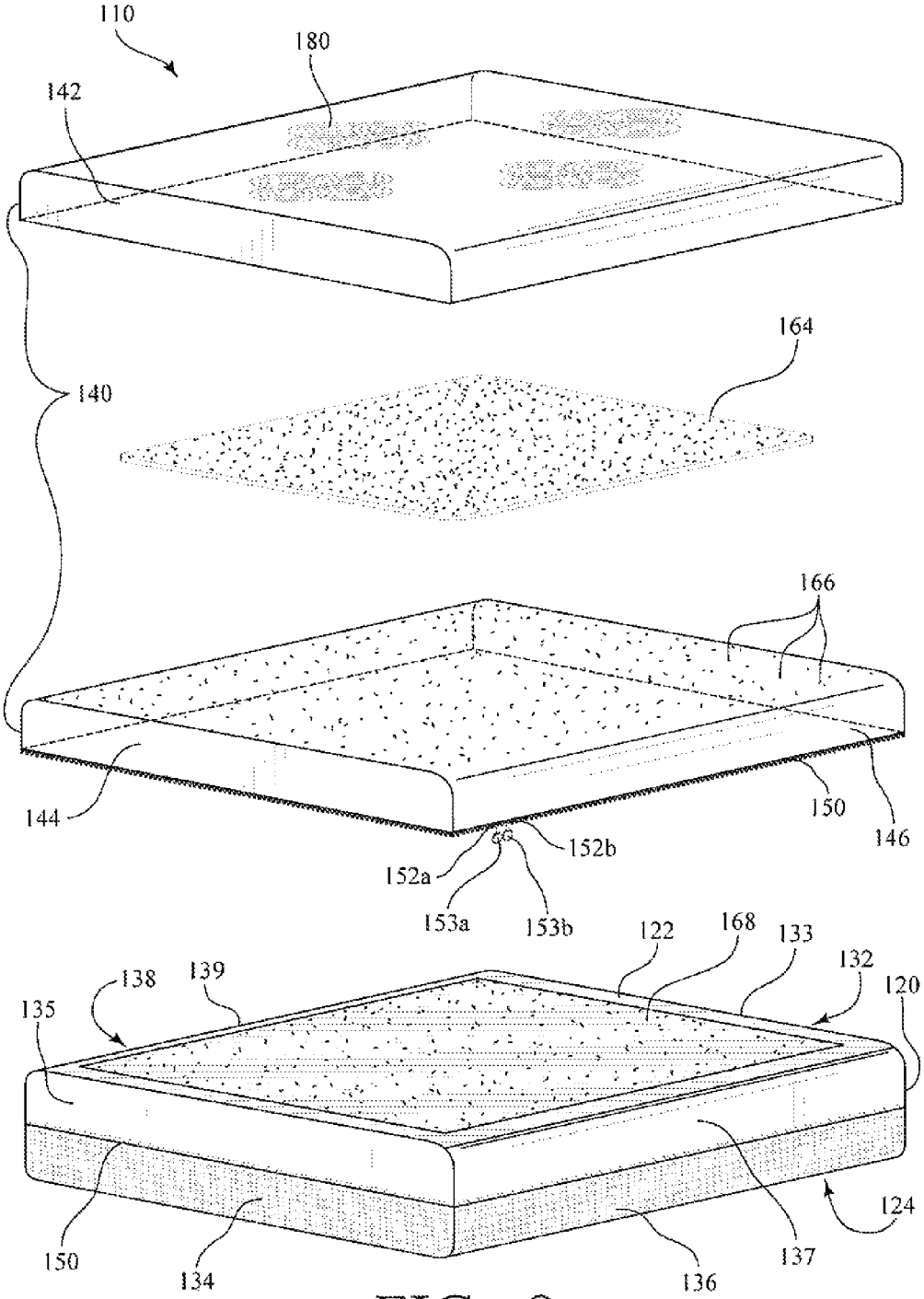
FIG. 8 is an exploded perspective view of the exemplary cover assembly of FIG. 7, showing the second cover removed from the top surface of the first cover and further showing the top surface and bottom surface of the second cover separated from one another with a flexible foam layer positioned between the top surface and bottom surface.

Referring now to FIGS. 7-8, in another exemplary embodiment of the present invention, a cover assembly 110 is provided that also includes a first cover 120 and a second cover 140. The first cover 120 again has a top panel 122 and a continuous side panel 130, with the continuous side panel again including a head panel 132, a foot panel 134, and two opposing side panels 136, 138. The top panel 122, the bottom panel 124, and the continuous side panel 130 again collectively define a cavity for enclosing a mattress. The second cover 140 of the cover assembly 110 also again includes a top surface 142 and a bottom surface 144, and a two-way separating zipper 150 having two slider bodies 152*a*, 152*b* with zipper pulls 153*a*, 153*b* and extending around the perimeter 146 of the second cover 140. Similar to the cover assembly 10 shown in FIGS. 1-6, the second cover 140 of the cover assembly 110 is also dimensionally-sized to cover the top panel 122 of the first cover 120. However, unlike the second cover 40 in the cover assembly 10 shown in FIGS. 1-6, in this exemplary embodiment, the second cover 140 of the cover assembly 110 covers not only the upper half 137, 139 of each opposing side panel 136, 138, but also covers the entire upper half 135 of the foot panel 134 and the entire upper half 133 of the head panel 132 to provide an additional amount of protection to the foot panel 134 and head panel 132.

In addition to increasing the area covered by the second cover 140 of the cover assembly 110, to further take advantage of the configuration of the second cover 140 relative to the first cover 120 and to provide an increased level of protection to the first cover 120 as well as any underlying mattress enclosed by the first cover 120, the bottom surface 144 of the second cover 140 also includes a water-impervious and vapor-permeable material 166. The water-impervious and vapor-permeable material 166 included in the bottom surface 144 of the second cover 140 can include materials such as expanded polytetrafluoroethylene (ePTFE, e.g., Gore-Tex®, W. L. Gore & Associates, Inc., Newark, Del.). In this regard, the water-impervious and vapor-permeable material 166 included in the bottom surface 144 of the second cover 140 thus prevent liquids from traveling through the top surface 142 and the bottom surface 144 of the second cover 140 into the first cover 120 and any underlying mattress, but yet allows vapors or moisture in the first cover 120 or in any underlying mattress to evaporate and travel though the second cover 140.

To provide a cover assembly 110 that is sufficiently "breathable" and allows air, heat, and moisture to travel through the cover assembly 110, but yet is also is sufficiently soft and durable, such that it can be easily cleaned and used to help prevent damage to the first cover 120 or an underlying mattress, the first cover 120, the second cover 140, or both are typically comprised of a textile. For example, in the embodiment shown in FIGS. 7-8, the second cover 140 is comprised of cotton in order to make the second cover 140 sufficiently-durable and capable of protecting the first cover 120, but yet machine-washable and easily cared for, such that the second cover 140 can be removed from the first cover 120, cleaned, and then reconnected to the first cover 120. Of course, 100% cotton materials, as well as numerous other textiles, including silk and textiles having varying percentages of cotton can also be readily used in any of the cover assemblies described herein and can be selected for a particular cover assembly or a particular application or type of mattress as desired.

In addition to using a textile to provide a level of protection to an underlying mattress, the exemplary cover assembly 110 also typically incorporates one or more flame-retardant materials into the first cover 120 and the second cover 140. By incorporating a flame-retardant material (e.g., a fire sock) into the first cover 120, the cover assembly 110 thus provides a flame-retardant barrier that completely surrounds an underlying mattress, such as a visco-elastic foam mattress as described herein below. Moreover, by incorporating a flame-retardant material into the second cover 140, the second cover 140 helps to prevent any flames or heated materials contacting the second cover 140 from damaging the underlying first cover 120.

With further respect to the configurations and materials used in the cover assembly 110, the first cover 120 of the cover assembly 110 also includes additional features to increase the comfort of a user lying on the cover assembly 110 (i.e., when the cover assembly 110 is used to on a mattress). More specifically, in the cover assembly 110, a flexible foam layer 164 is positioned between the top surface 142 and bottom surface 144 of the second cover 140, and thus acts an overlay that can be placed on top of a mattress along with the second cover 140 and used to provide an additional amount of comfort to a user. In the exemplary embodiment shown in FIGS. 7-8, the flexible foam layer 164 is comprised of a visco-elastic foam that, as described in further detail below, has a density and hardness configured to provide a desired degree of comfort and body-conforming qualities, but yet also provides a sufficient degree of material durability to allow it to be incorporated into the second cover 140.

As an even further addition to the cover assembly 110 that increases the comfort of a user lying on the cover assembly 110, the first cover 120 of the cover assembly 110 further includes a charcoal sheet 168. As shown best in FIG. 8, the charcoal sheet 168 is incorporated into the top panel 122 of the first cover 120, and is thus positioned to eliminate or mitigate the presence of any odors or chemicals present in or being emitted from the cover assembly 110 or, in particular, in a mattress enclosed by the first cover 120. For instance, in some embodiments, in which the first cover of the cover assembly 110 is used to surround a newly-produced mattress comprised of a flexible foam, the charcoal sheet 168 provides an effective means to eliminate or mitigate the gases and odors that are initially present in such mattresses. Of course, such charcoal sheets can also be incorporated into a second cover of an exemplary cover assembly of the present invention without departing from the spirit and scope of the subject matter described herein. In addition, although a charcoal sheet is preferably used in connection with cover assemblies of the present invention as it is sufficiently non-toxic and can readily be incorporated into a cover assembly for a mattress, it is contemplated that the present cover assemblies can also readily incorporate other odor or gas eliminating agents, including more chemical-based coatings for eliminating odors or gases.

Figure 9:
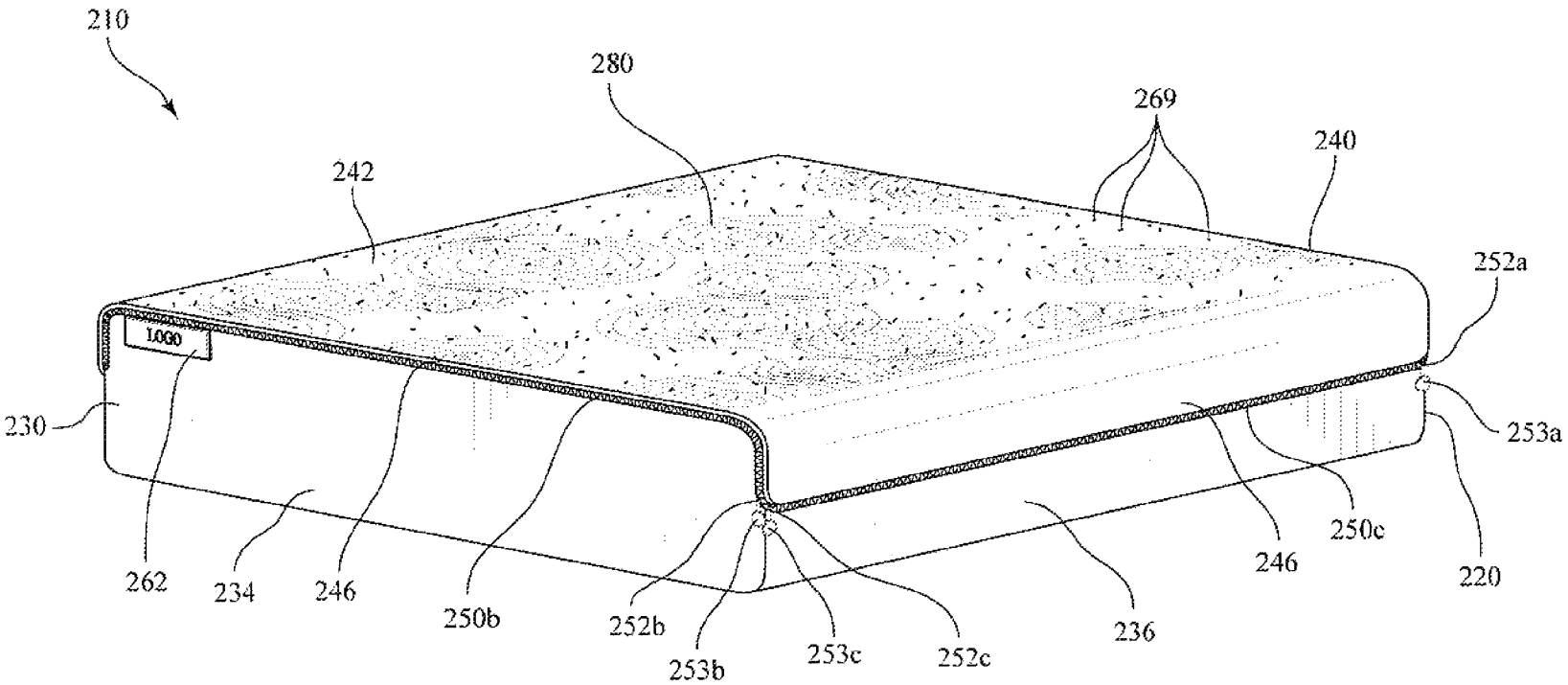
FIG. 9 is a perspective view of yet another exemplary cover assembly made in accordance with the present invention.
Figure 10:
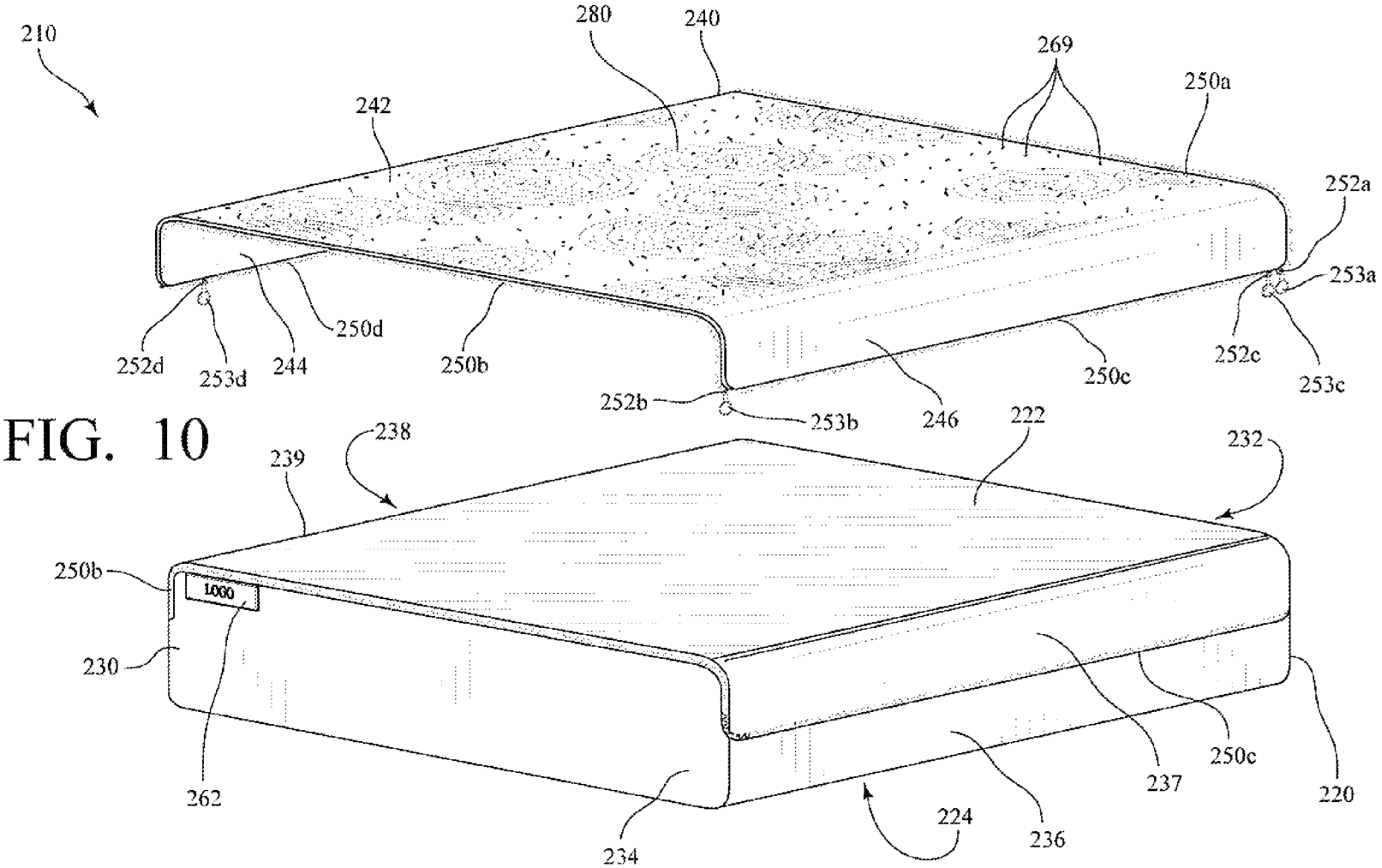
FIG. 10 is an exploded perspective view of the exemplary cover assembly of FIG. 9, showing the second cover removed from the top surface of the first cover.
Figure 11:
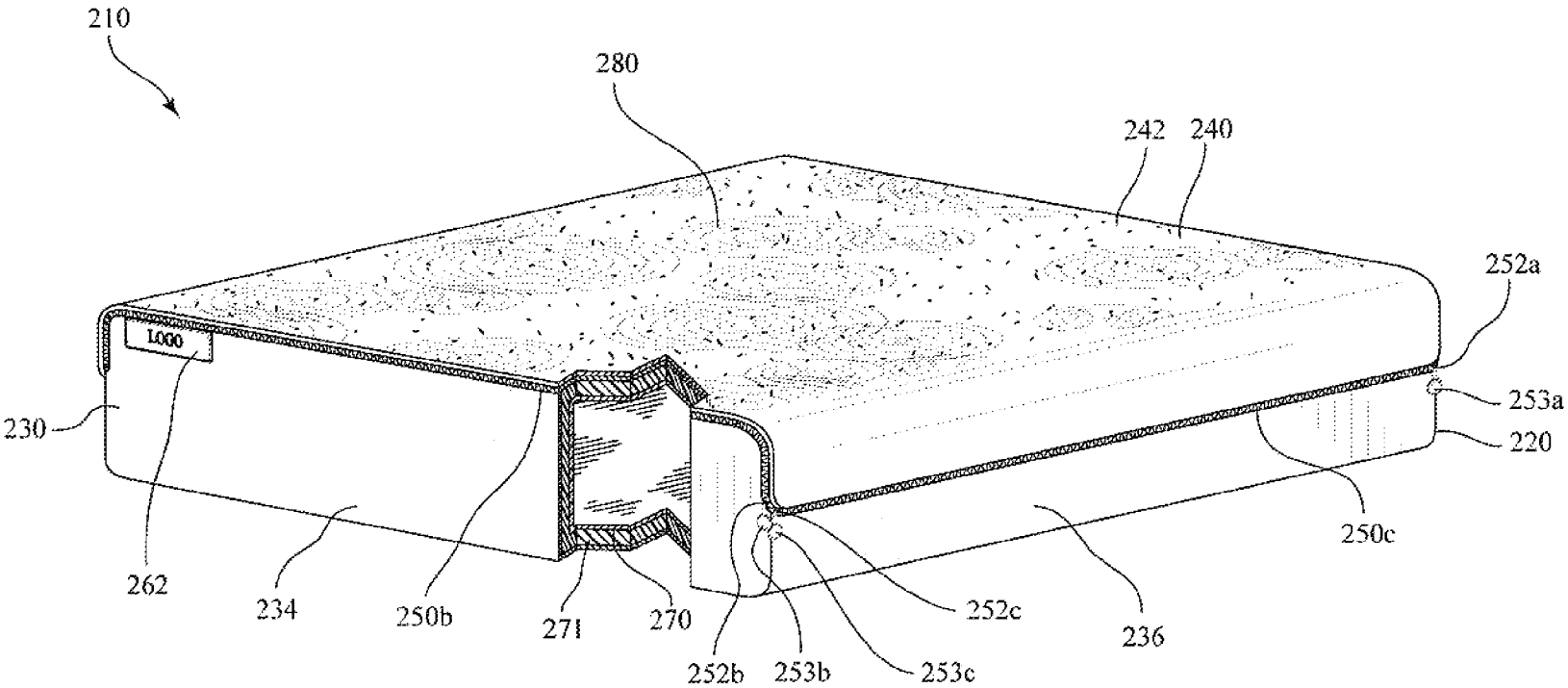
FIG. 11 is another perspective view of the exemplary cover assembly of FIG. 9, but with a portion of the cover assembly removed to show an underlying mattress including an air bladder.

Referring now to FIGS. 9-11, in another exemplary embodiment of the present invention, a cover assembly 210 is provided that also includes additional features to increase the comfort of a user. Like the cover assemblies 10, 110 shown in FIGS. 1-6 and 7-8, the cover assembly 210 includes a first cover 220 having a top panel 222, a bottom panel 224, and a continuous side panel 230. The continuous side panel 230 can once more be characterized as having a head panel 232, a foot panel 234, and two opposing side panels 236, 238, with the top panel 222, the bottom panel 224, and the continuous side panel 230 collectively defining a cavity for enclosing a mattress. The cover assembly 210 also includes a second cover 240 having a top surface 242 and a bottom surface 244. Rather than incorporating a flexible foam layer or a charcoal sheet into the second cover 240, however, the second cover 240 includes an amount of phase change material 269 incorporated into the top surface 242 of the second cover 240.

The phase change material 269 that is incorporated into the top surface 242 of the second cover 240 is typically comprised of microspheres that include substances having a high heat of fusion and that store or release heat as the substances oscillate between solid and liquid form (i.e., phase change materials). As the phase change material 269 included in the top surface 242 of the second cover 240 changes from solid to liquid form (i.e., melts) as the result of heat generated by a user lying on the cover assembly 210, the phase change material 269 thus continually absorbs heat and provides a cooling effect to the user until all of the phase change material 269 has been transformed from a solid to a liquid form. In the top surface 242 of the second cover 240, the phase change material 269 is incorporated into the top surface 242 by infusing and coating the top surface 242 of the second cover with the microspheres of phase change material 269. However, it is, of course, contemplated that the phase change material 269 need not be infused into and/or used to coat only the top surface 242 of the second cover 240, but could also be infused into and/or used to coat the bottom surface 244 of the second cover 240, or the top panel 222 of the first cover 220 to provide a sufficient amount of cooling to the body of a user lying on the cover assembly 210.

Referring still to FIGS. 9-11, the second cover 240 of the cover assembly 210 is also dimensionally-sized to cover the top panel 222 of the first cover 220. However, unlike the cover assemblies 10, 110 shown in FIGS. 1-6 and 7-8, the cover assembly 210 does not cover any portion of the foot panel 234 or head panel 232 of the first cover 220. Rather, the second cover 240 is dimensionally-sized to only cover the top panel 222 and the upper half 237, 239 of each opposing side panel 236, 238 of the first cover 220. Moreover, unlike the cover assemblies 10, 110 shown in FIGS. 1-6 and 7-8, the fastener connecting the second cover 240 to the first cover 220 along the perimeter 246 of the second cover 240 is not in the form of a two-way separating zipper. Instead, the fastener included on the cover assembly 210 is in the form of four separate zippers 250*a*, 250*b*, 250*c*, 250*d*. Each of the four separate zippers 250*a*, 250*b*, 250*c*, 250*d* includes a slider body 252*a*, 252*b*, 252*c*, 252*d* and a pull tab 253*a*, 253*b*, 253*c*, 253*d*, and each of the zippers 250*a*, 250*b*, 250*c*, 250*d* is positioned along a single side of the perimeter 246 of the second cover 240. More specifically, one zipper 250*b* extends along the foot panel 234 of the first cover 220, one zipper 250*a* extends along the head panel 232 of the first cover 220, and one zipper 250*c*, 250*d* extends along each side panel 236, 238 of the first cover 220. Of course, it is contemplated that zippers need not be used at all, but that other fasteners including snaps, buttons, hook-and-loop fasteners, and the like can also be used to connect a second cover to a first cover of an exemplary cover assembly without departing from the spirit and scope of the subject matter described herein.

Figure 12:
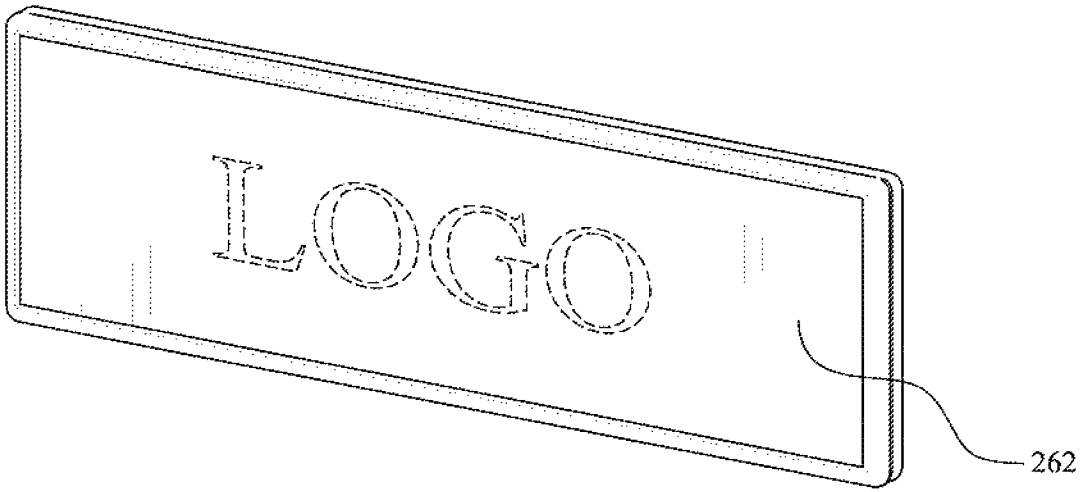
FIG. 12 is a perspective view of an exemplary brand tag for placement on a cover assembly made in accordance with the present invention.
Figure 13:
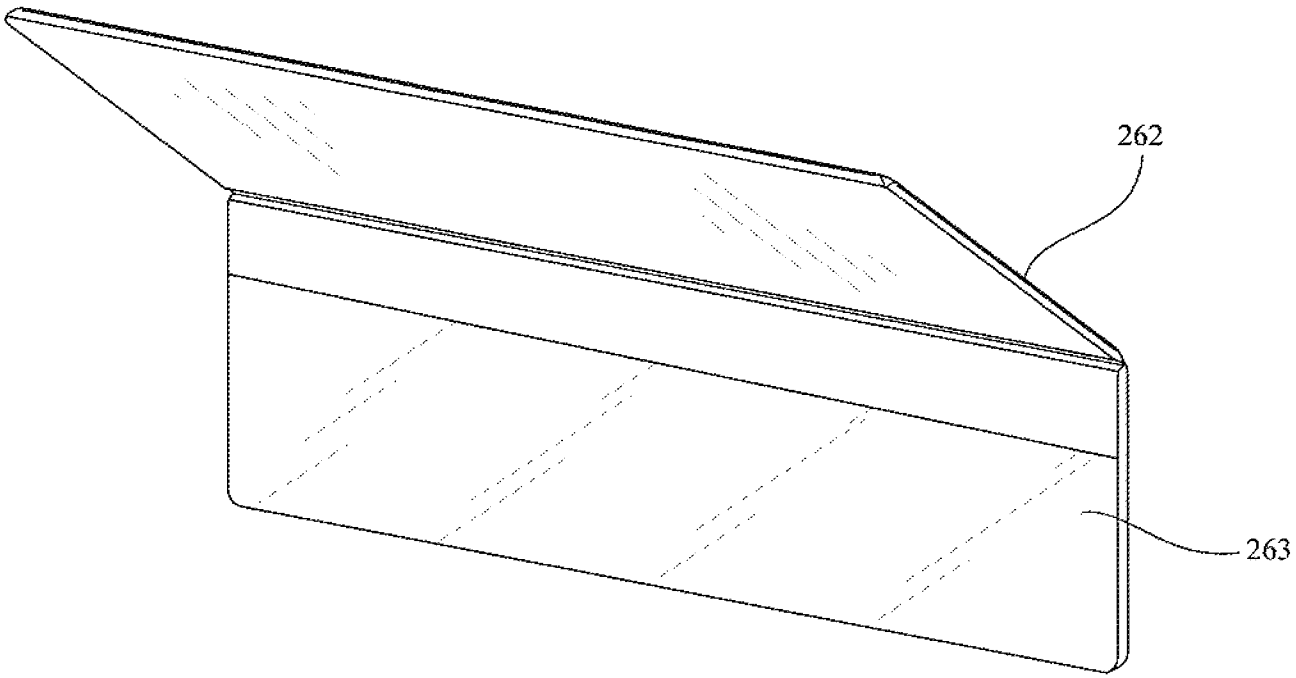
FIG. 13 is another perspective view of the exemplary brand tag of FIG. 12, showing the brand tag in an open configuration and including a pocket.

Referring still to FIGS. 9-11, along with FIGS. 12-13, as a further refinement to the cover assemblies of the present invention, the cover assembly 210 includes a brand tag 262 that is secured to the foot panel 234 of the first cover 220. The brand tag 262 has a size sufficient to display a logo and can be secured to the foot panel 234 using a variety of means including glue, hook-and-loop fasteners, stitching, and the like. Unlike traditional brand tags in which a fabric logo is sewn to a cover or mattress, however, the brand tag 262 is typically made of a sufficiently rigid material (e.g., a plastic) and includes an interior pocket 263, as best shown in FIGS. 12-13. In this regard, the brand tag 262 can also be used to store various materials in the interior pocket 263 that may be associated with the cover assembly 210 or an underlying mattress including for example, warranty information for the cover assembly 210 or underlying mattress.

As an additional refinement to the cover assemblies of the present invention, the cover assemblies can also include an indicia on either the first cover the second cover, or both the first cover and the second cover that is indicative of and allows a user to visually identify a characteristic of the particular mattress covered by the cover assembly. Such indicia can include patterns, colors, or combinations of patterns and colors, and can be positioned at a variety of different locations on the first and second cover. For example, the cover assembly 10 shown in FIGS. 1-6 includes an indicia in the form of an interlocking circle pattern 80 that is positioned on the top surface 42 of the second cover 40. As another example, the cover assembly 110 shown in FIGS. 7-8 includes an indicia in the form of sets of overlapping circles 180 on the top surface 42 of the second cover 40 and multiple rows of geometric shapes 181 that are embossed or debossed into both the foot panel 134 of the first cover 120 and the opposing side panels 136, 138 of the first cover 120 only one of which is shown in FIGS. 7-8.

Regardless of the type or location of the indicia, as noted, the indicia is preferably used to indicate a characteristic of the particular mattress that is covered by the cover assembly of the present invention. Such characteristics include, but are not limited to, the firmness of a particular mattress or the type of mattress that is covered by the cover assembly. For example, and referring now specifically to FIG. 11, the exemplary cover assembly 210 includes an indicia in the form of a plurality of randomly-sized circles 280 that are designated to indicate that the exemplary cover assembly 210 is covering a mattress having an air bladder 270 surrounded by a layer of flexible foam 271. In this regard, when a user approaches the cover assembly 210, the user visualizes the indicia including the plurality of randomly-sized circles 280 and then identifies the plurality of randomly-sized circles 280 on the top surface 242 of the second cover 240 as being indicative of the mattress that includes the air bladder 270 surrounded by a foam layer 271 and that is enclosed by the first cover 220.

Figure 14:
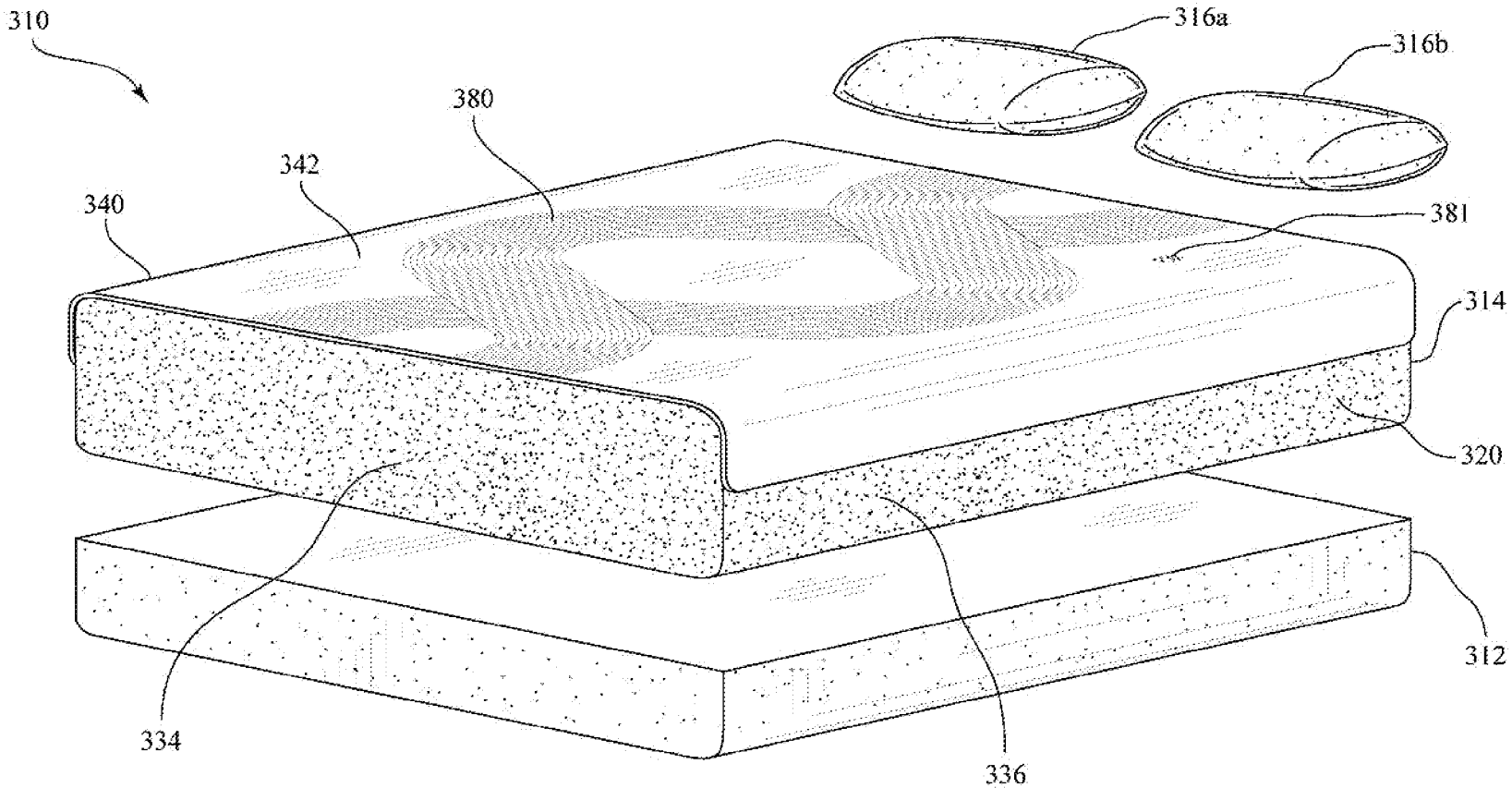
FIG. 14 is a perspective view of an exemplary bed assembly incorporating an exemplary cover assembly made in accordance with the present invention.
Figure 15:
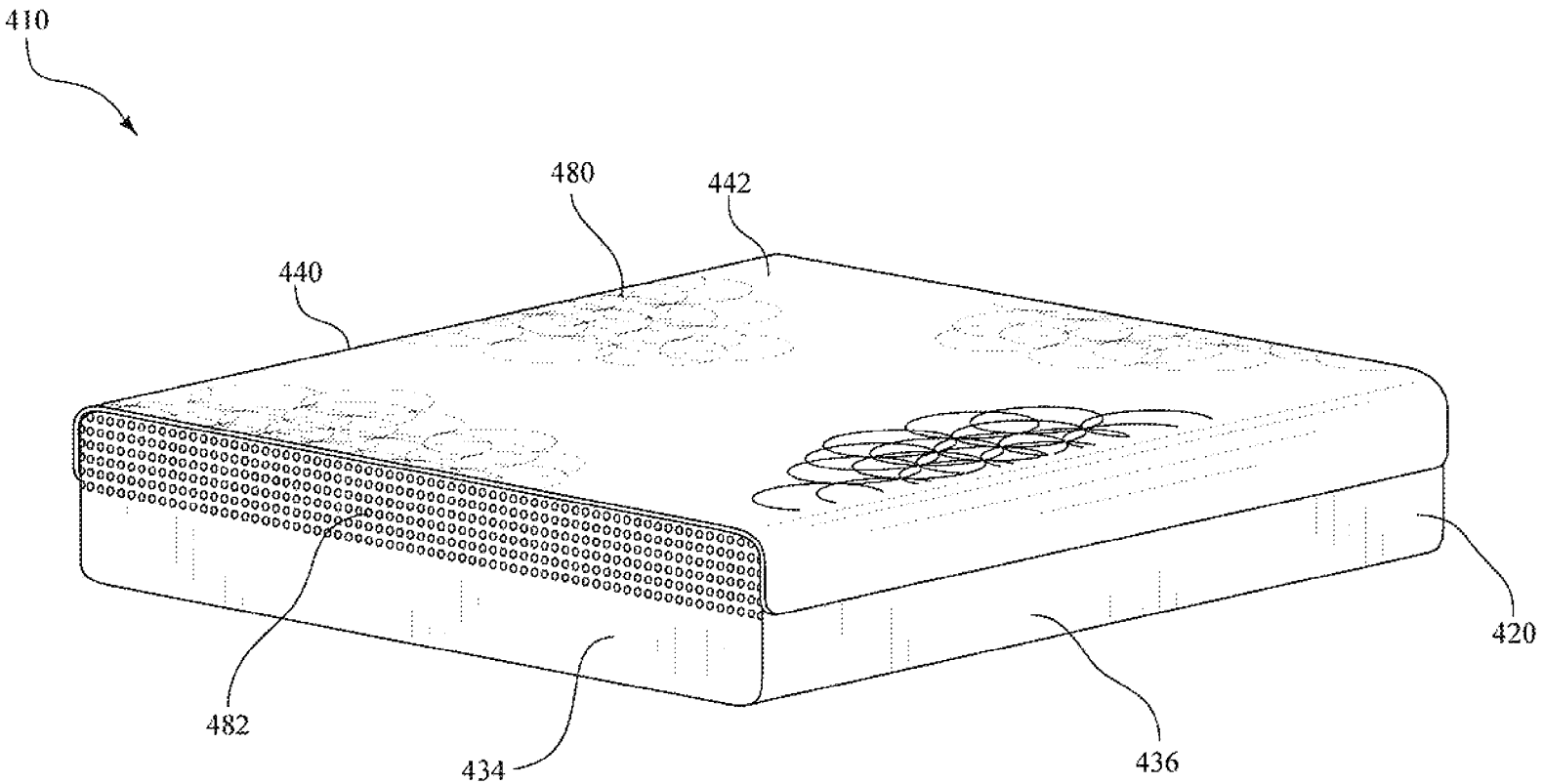
FIG. 15 is a perspective view of yet another exemplary cover assembly made in accordance with the present invention.
Figure 16:
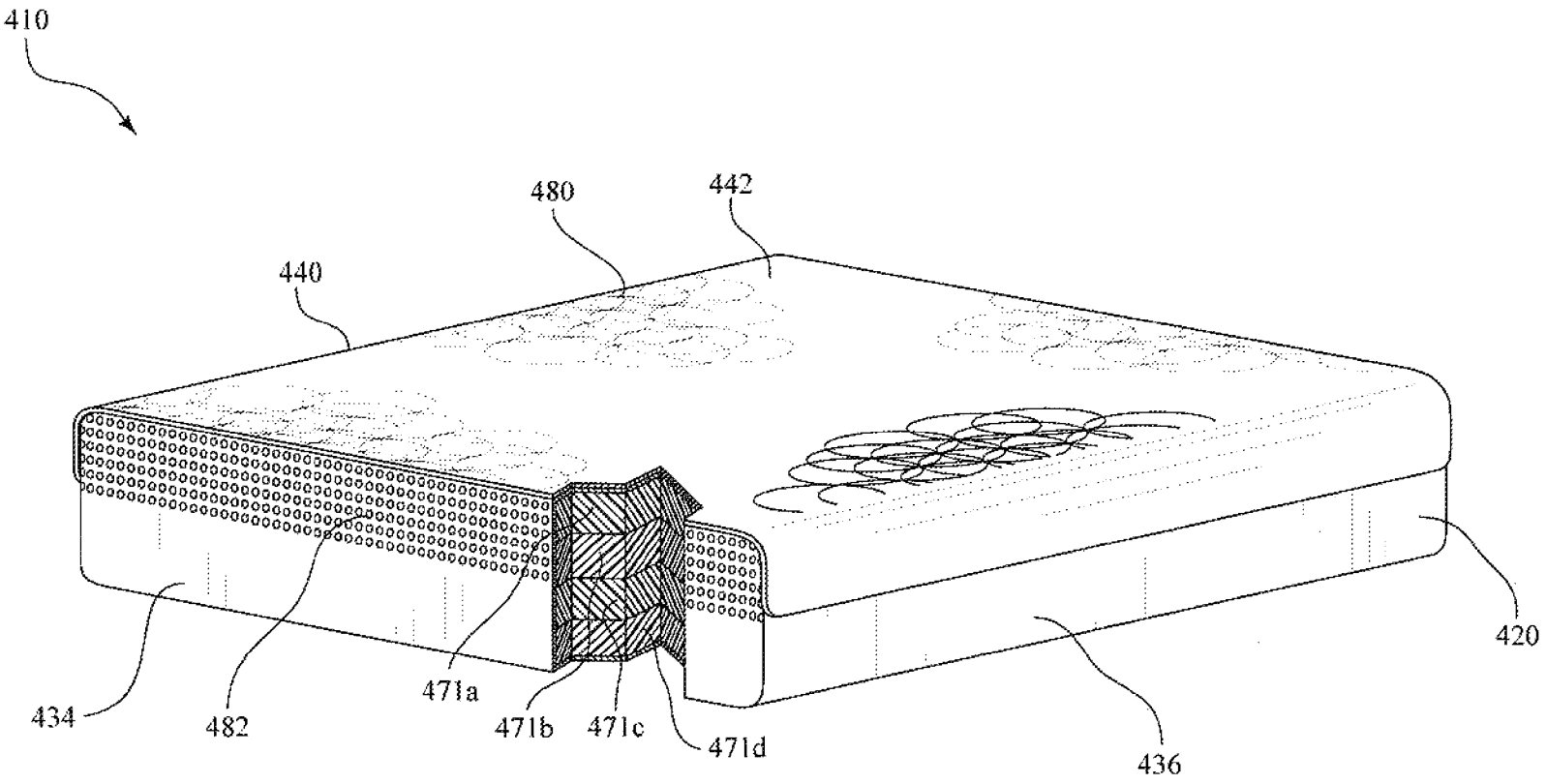
FIG. 16 is another perspective view of the exemplary cover assembly of FIG. 15, but with a portion of the cover assembly removed to show an underlying mattress comprised of four layers of visco-elastic foam.

As another example of the use of indicia, and referring now to FIG. 14, another exemplary cover assembly 310 is provided that includes a first cover 320 defining a cavity for enclosing a mattress. The cover assembly 310 also includes a second cover 340 having a top surface 342. Similar to the cover assemblies 10, 110, 210 described above, the top surface 342 of the cover assembly 310 includes a pattern in the form of two series of curved lines 380. Additionally, and unlike the cover assemblies 10, 110, 210 described above, the cover assembly 310 also includes a further indicia in the form of a color applied to the first cover 320 (as indicated by the stippling shown on the first cover 320), that has been designated to indicate that the cover assembly 310 is being used to enclose a mattress comprised of a flexible foam and, more particularly, a visco-elastic foam.

Referring still to FIG. 14, in addition to the two series of curved lines 380 applied to the second cover 340 and the color applied to the first cover 320, the second cover of the cover assembly 310 further includes a dot 381 positioned on the top surface 342 of the second cover 342. The dot 381 has a color that is substantially identical to the color applied to the first cover 320, such that both the second cover 342 and the first cover 320 include substantially the same indicia for identifying the characteristic of the mattress. Furthermore, as also shown in FIG. 14, a set of pillows 316*a*, 316*b* and a foundation 312 having substantially the same color as the dot 381 and the first cover 320 can be used in conjunction with the cover assembly 310. In this regard, the cover assembly 310 can thus be used as an overall system in which multiple components of a bed assembly (e.g., a foundation, pillow, and a mattress cover) are marked with an indicia to allow for visual identification of a characteristic of a mattress, such as a flexible foam type of mattress.

With respect to the flexible foams used in the mattresses and flexible foam layers that are covered by the cover assemblies of the present invention, as noted above, the mattresses and flexible foam layers are generally comprised of a flexible foam that has a low resilience as well as a sufficient density and hardness, which allows pressure to be absorbed uniformly and distributed evenly across the various mattresses and flexible foam layers. Such flexible foams include, but are not limited to latex foam; reticulated or non-reticulated visco-elastic foam (sometimes referred to as memory foam or low-resilience foam); reticulated or non-reticulated non-visco-elastic foam; high-resilience polyurethane foam; expanded polymer foams (e.g., expanded ethylene vinyl acetate, polypropylene, polystyrene, or polyethylene); and the like.

With respect to the hardness of the visco-elastic foams used in certain of the mattresses and flexible foam layers, suitable visco-elastic foams typically have a hardness of at least about 10 N to no greater than about 80 N, as measured by exerting pressure from a plate against a sample of the material to a compression of at least 40% of an original, thickness of the material at approximately room temperature (i.e., 21° C. to 23° C.) where the 40% compression is held for a set period of time as established by the International Organization of Standardization (ISO) 2439 hardness measuring standard. In some embodiments, the visco-elastic foam can have a hardness of about 10 N, about 20 N, about 30 N, about 40 N, about 50 N, about 60 N, about 70 N, or about 80 N to provide a desired degree of comfort and body-conforming qualities.

With respect to the density of the visco-elastic foams used in certain of the mattresses and flexible foam layers, suitable visco-elastic foams have a density that also assists in providing a desired degree of comfort and body-conforming qualities, as well as an increased degree of material durability. In some embodiments, the density of the visco-elastic foam used in the mattresses and flexible foam layers is no less than about 30 kg/m$^3$ to no greater than about 150 kg/m$^3$. In some embodiments, the density of the visco-elastic foam that is used is about 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a visco-elastic foam having a particular density will affect other characteristics of the foam, including its hardness, the manner in which the foam responds to pressure, and the overall feel of the foam, but it should be appreciated that a visco-elastic foam having a desired density and hardness can readily be selected for a particular application or assembly as desired.

Additionally, it should be appreciated that the visco-elastic foam used in the mattresses and foam layers described for use with the cover assemblies of the present invention need not be comprised of a single piece of visco-elastic foam, but can be comprised of multiple layers of visco-elastic foam with the layers having different densities and hardnesses. For example, in some embodiments, a visco-elastic foam mattress can be utilized that includes a lower supporting layer of visco-elastic foam with a density of about 80 kg/m3 and a hardness of about 13 N, and an upper comfort layer of visco-elastic foam with a density of about 35 kg/m$^3$ and a hardness of about 10 N.

Turning now to FIGS. 15-20, in other exemplary embodiments of the present invention, cover assemblies 410, 510, 610 are provided that include multiple indicia that are each indicative of a separate characteristic of a mattress. For example, referring first to FIG. 15-16, in one exemplary embodiment, a cover assembly 510 is provided that, like the cover assemblies described above, includes a first cover 420 defining a cavity for enclosing a mattress, and a second cover 440 positioned over the first cover 420 and including a first indicia in the form of groupings of joined circles 480. In the exemplary cover assembly 410, the groupings of joined circles 480 are positioned on the top surface 442 of the second cover 440 and are used to indicate that the cover assembly 410 is being used to cover a mattress comprised of visco-elastic foam. In addition to the groupings of joined circles 480, however, the cover assembly 410 further includes a second indicia in the form of six rows of embossed circles 482 that are positioned on a foot panel 434 of the first cover 420 and that are indicative of a second characteristic of the mattress, namely multiple layers of visco-elastic foam. In particular, in the cover assembly 410, the six rows of embossed circles 482 are used to indicate that the mattress surrounded by the cover assembly is comprised of four layers of visco-elastic foam 471*a*, 471*b*, 471*c*, 471*d* with each layer of visco-elastic foam 471*a*, 471 *b*, 471*c*, 471*d* decreasing in both hardness and density from the bottom layer 471*d* to the top layer 471*a*.

Figure 17:
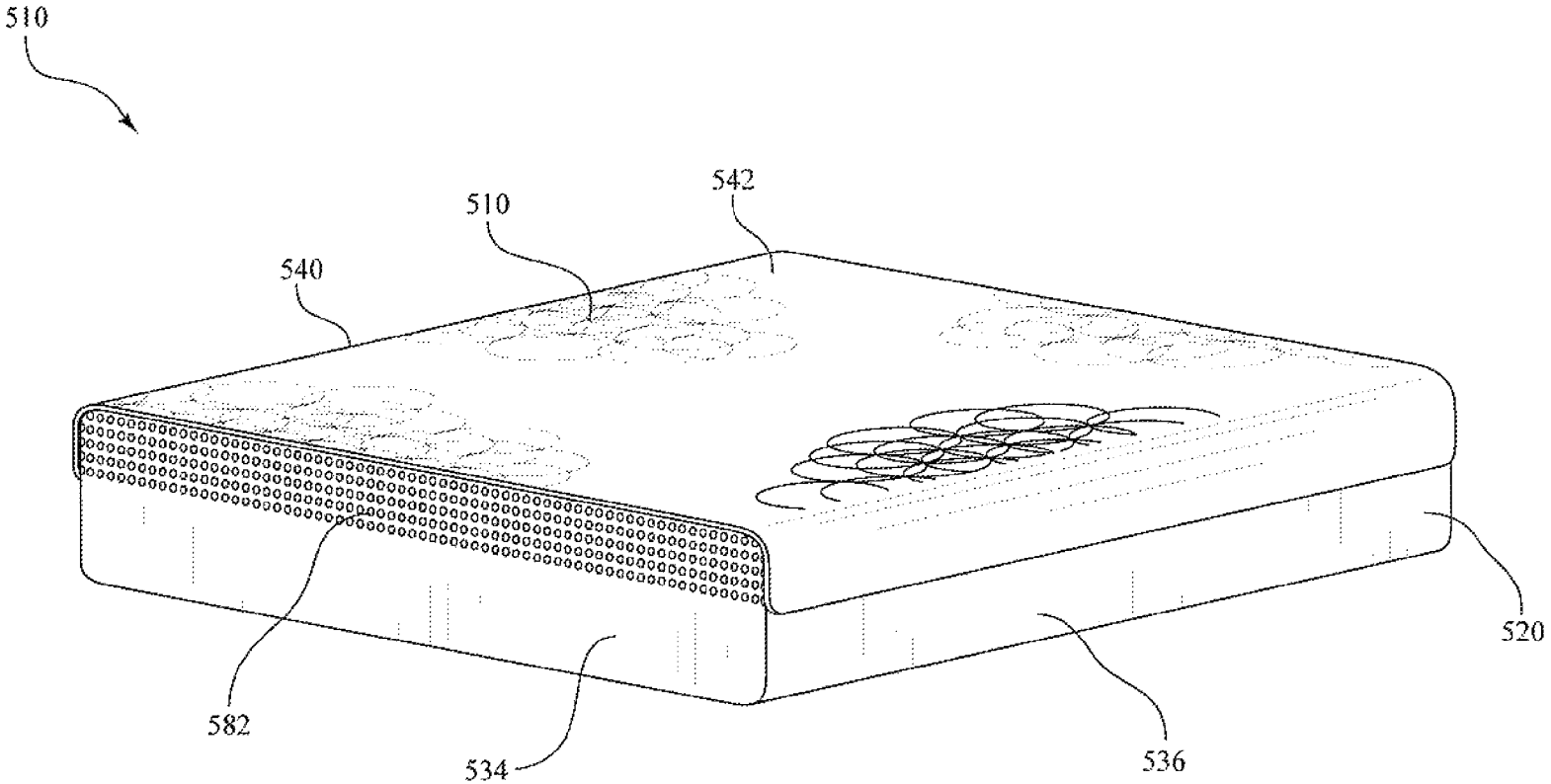
FIG. 17 is a perspective view of yet another exemplary cover assembly made in accordance with the present invention.
Figure 18:
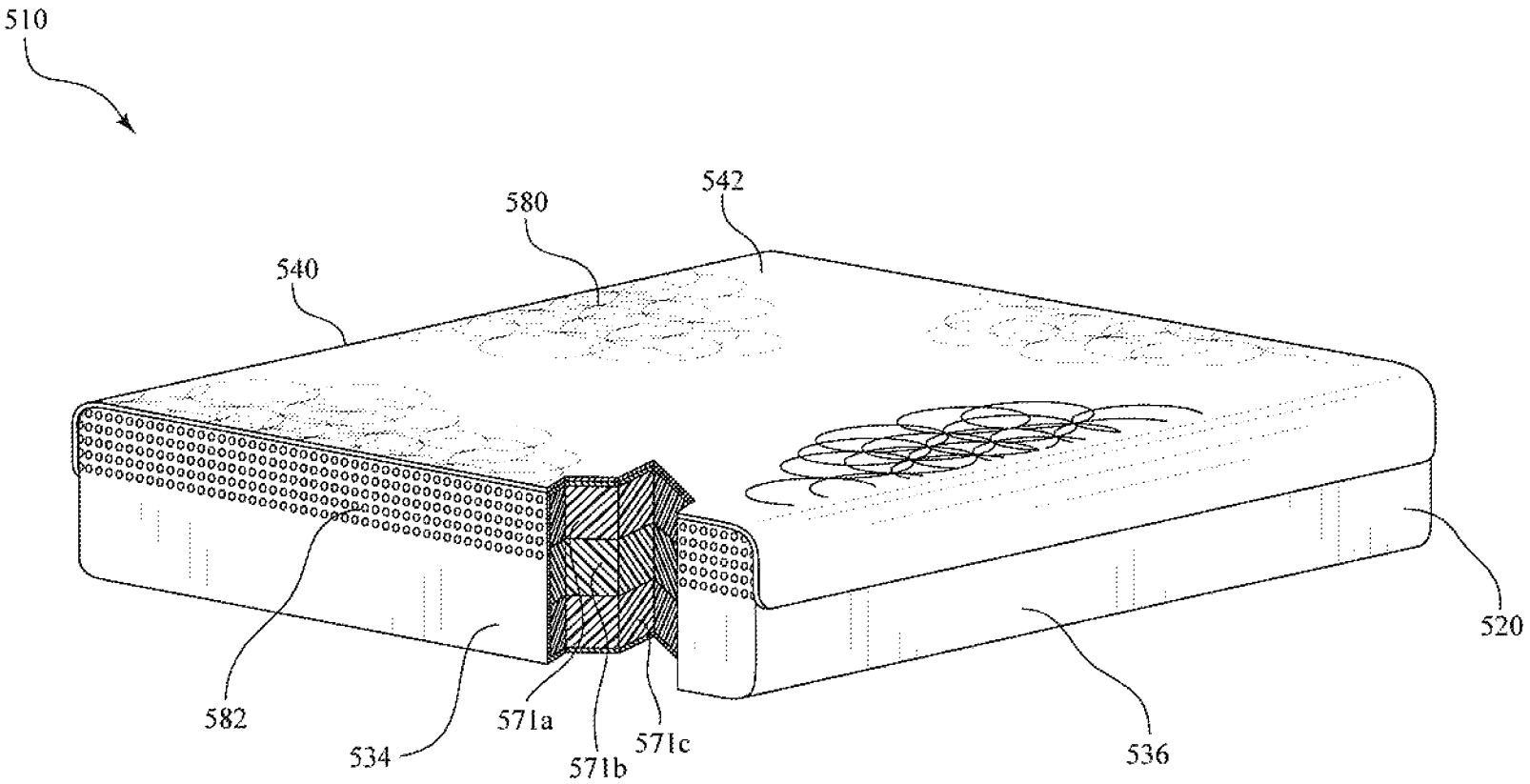
FIG. 18 is another perspective view of the cover assembly of FIG. 17, but with a portion of the cover assembly removed to show an underlying mattress comprised of three layers of visco-elastic foam.

As another example of the use of multiple indicia to indicate multiple characteristics of a mattress, and referring now to FIGS. 17-18, a cover assembly 510 is provided that again includes a first cover 520 defining a cavity for enclosing a mattress, and a second cover 540 positioned over the first cover 520 and including a first indicia in the form of groupings of joined circles 580 that are indicative of an underlying mattress comprised of visco-elastic foam. Unlike the cover assembly 410 shown in FIGS. 15-16, however, the end panel 534 of the first cover 520 of the cover assembly 510 only includes five rows of embossed circles 582 in order to indicate that the mattress being covered by the cover assembly 510 is not comprised of four layers of visco-elastic foam, but instead includes three layers of visco-elastic foam 571*a*, 571*b*, 571*c* that decrease in density and hardness from the bottom layer 571*c* to the top layer 571*a*.

Figure 19:
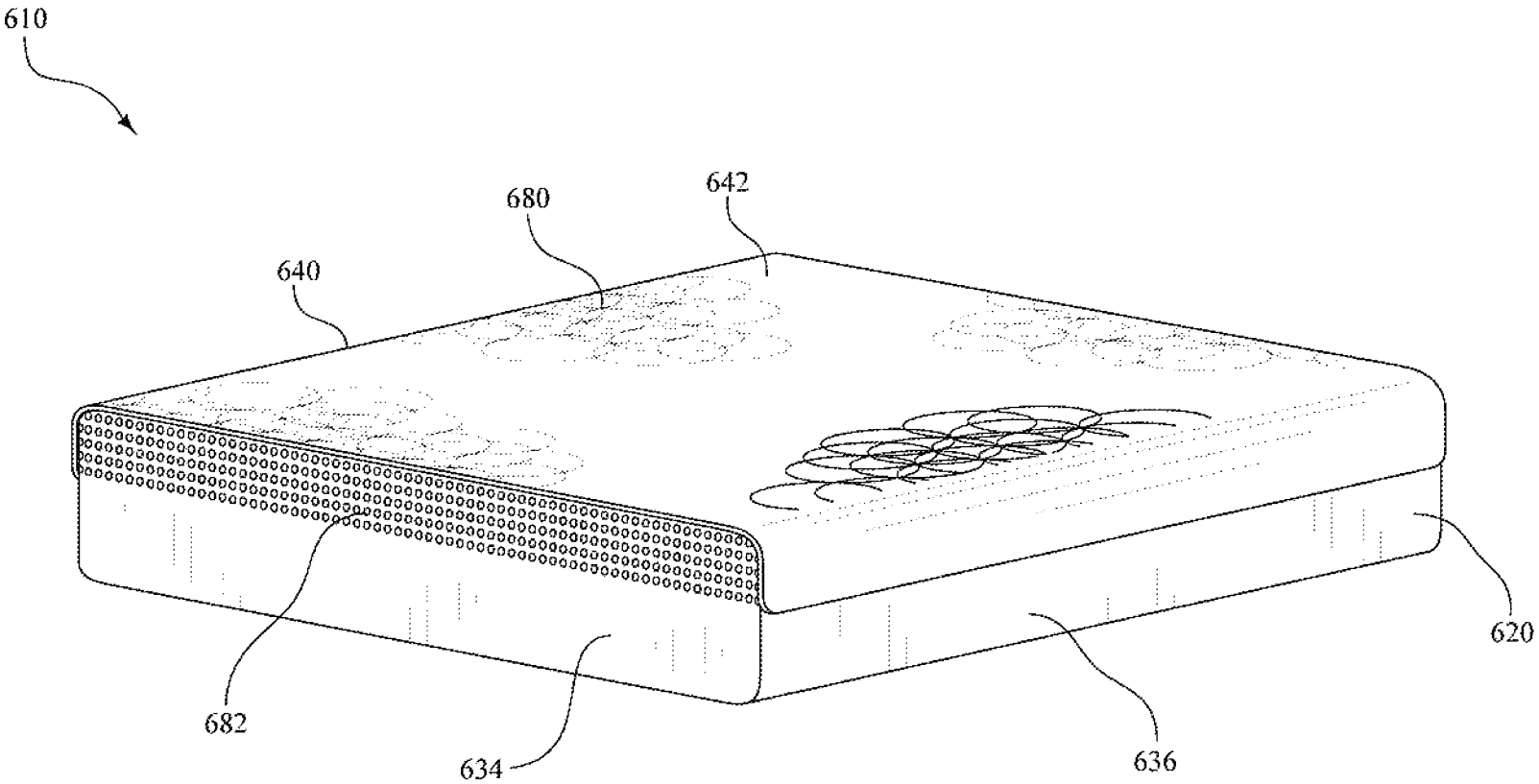
FIG. 19 is a perspective view of yet another exemplary cover assembly made in accordance with the present invention.
Figure 20:
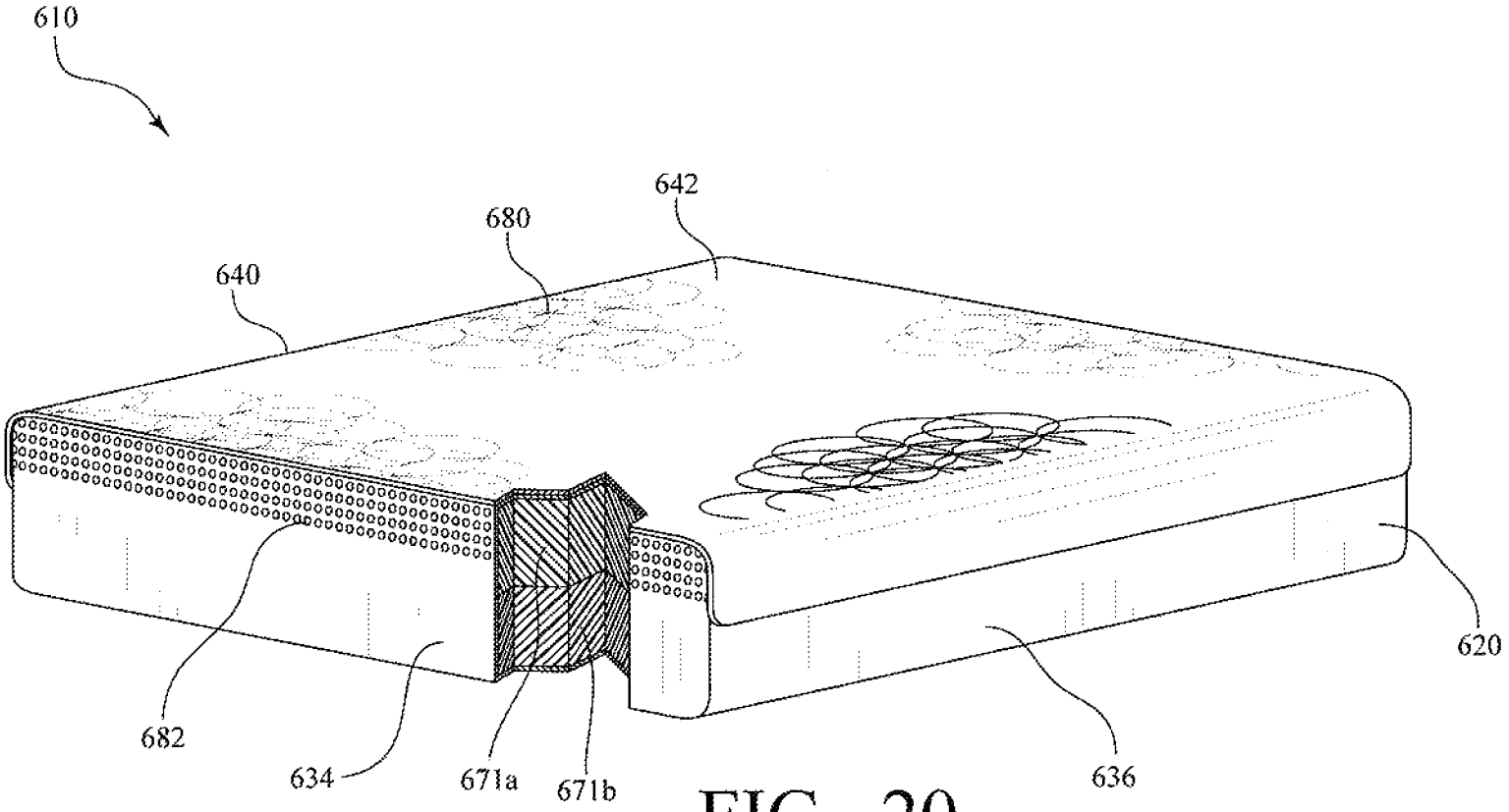
FIG. 20 is another perspective view of the cover assembly of FIG. 19, but with a portion of the cover assembly removed to show an underlying mattress comprised of two layers of visco-elastic foam.

In a similar fashion, and referring now to FIGS. 19-20, a cover assembly 610 is provided in a further embodiment of the present invention that, like the cover assemblies 410, 510 shown in FIGS. 15-18, includes a first cover 620 defining a cavity for enclosing a mattress, and a second cover 640 positioned over the first cover 620 and including a first indicia in the form of groupings of joined circles 680 that are indicative of an underlying mattress comprised of visco-elastic foam. In the cover assembly 610, however, only four rows of circles 682 are included on the foot panel to indicate that the underlying mattress is comprised of two layers of visco-elastic foam 671*a*, 671*b* with the upper visco-elastic foam layer 671*a* having a density and hardness less than that of the lower visco-elastic foam layer 671*b*.

With respect to the indicia included on an exemplary cover, it is understood that while the exemplary cover assemblies 410, 510, 610 make use of specific patterns and multiple rows of geometric shapes as indicia indicative of, respectively, a first characteristic and second characteristic of a mattress, numerous other patterns, colors, and the like can be incorporated into an exemplary cover assembly and designated to indicate a particular characteristic of a mattress. It is further understood that while the indicia 482, 582, 682 on the cover assemblies 410, 510, 610 described above have been used to indicate a number of layers of visco-elastic foam or varying hardnesses or densities of layers of visco-elastic foam, such indicia can also be used to indicate any number of other characteristics of a mattress without departing from the spirit and scope of the subject matter described herein.

By placing indicia on the cover assemblies of the present invention, each of the cover assemblies described herein can also be used as part of a method for marking a mattress to allow for visual identification of a characteristic of a mattress. In some implementations, a method for marking a mattress to allow for visual identification of a characteristic of the mattress includes first providing a mattress cover assembly having a first cover for enclosing a mattress and a second cover positioned over and dimensionally-sized to cover at least the top panel of the first cover. The top surface of the second cover is then marked with a first indicia that is indicative of a first characteristic of the mattress, such that a user can then visually identify a characteristic of the mattress by simply observing the mattress and associating the indicia with the characteristic (e.g. the firmness or type of the mattress). In some implementations, a second indicia can then also be marked on the foot panel of the first cover, the two opposing side panels, or both the foot panel and the two opposing side panels, where the second indicia is indicative of either the first characteristic of the mattress or is indicative of a second characteristic of the mattress, as described above.

Figure 21:
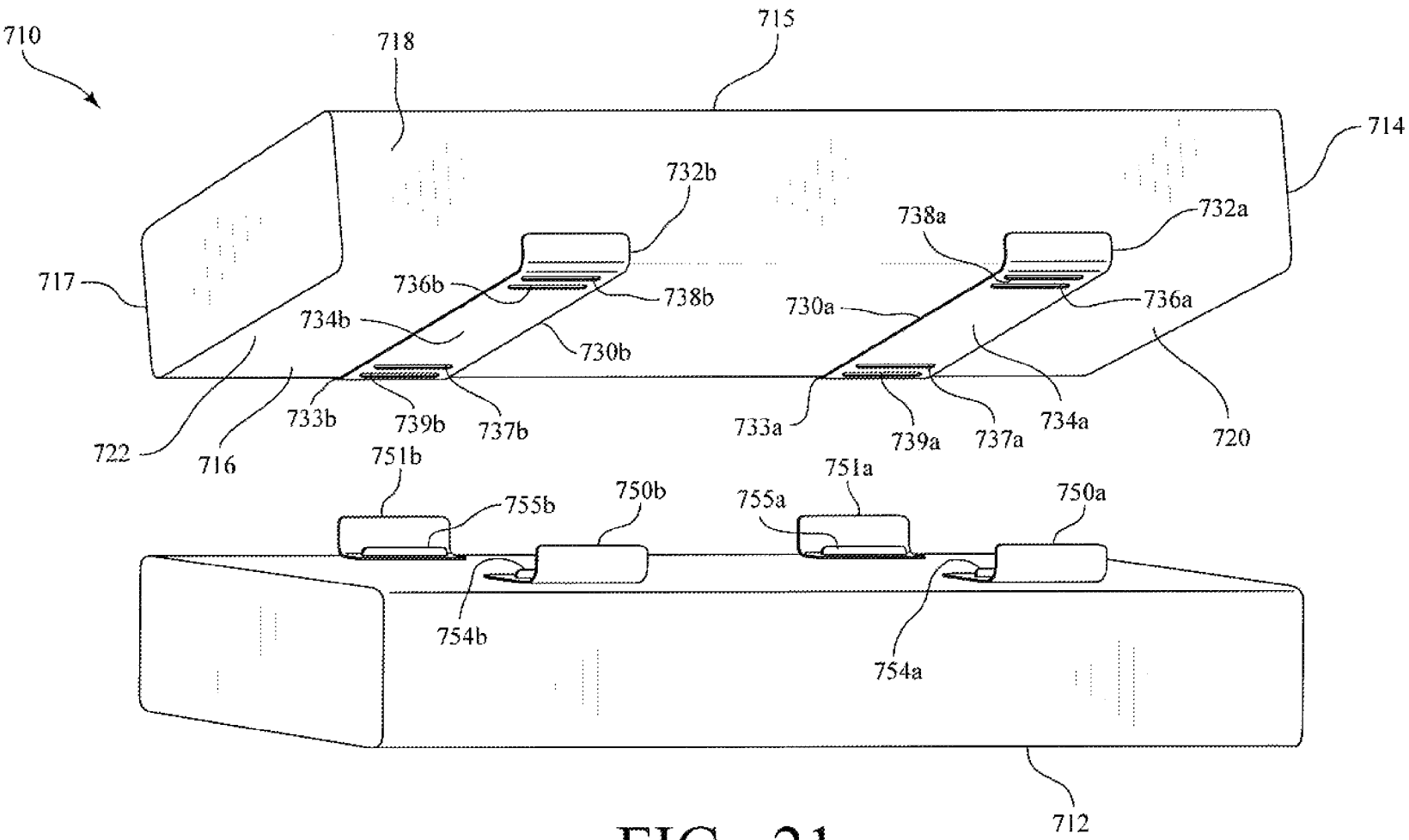
FIG. 21 is a perspective view of an exemplary alignment system for a mattress made in accordance with the present invention.

As an even further refinement to the cover and bed assemblies described herein, and referring now to FIG. 21, an exemplary bed assembly 710 is provided that includes an alignment system for aligning a mattress assembly (e.g., a mattress assembly incorporating a cover assembly of the present invention) on a foundation. The bed assembly 710 making use of the alignment system includes a foundation 712 and a mattress 714 having a first surface 715, a second surface 716 opposite the first surface 715, and opposing sides 717, 718. A first alignment member 730*a* is attached to the head portion 720 of the second surface 716 of the mattress 714, while a second alignment member 730*b* is attached to the foot portion 722 of the second surface 716 of the mattress 714. The alignment members 730*a*, 730*b* are both made of rigid plastic material or other material having a strength sufficient to support the mattress 714.

The first alignment member 730*a* includes a first curved end 732*a* and a second curved end 733*a* that, although not fully shown in FIG. 21, is substantially a mirror image of the first curved end 732*a*. The second alignment member 730*b* also includes a first curved end 732*b* and a second curved end 733*b* that are mirror images of one another. Both the first alignment member 730*a* and the second alignment member 730*b* also include elongated center segments 734*a*, 734*b* having a length that allows each of the alignment members 730*a*, 730*b* to span the width of the mattress 714. In this regard, when the first alignment member 730*a* and the second alignment member 730*b* are placed on the second surface 716 of the mattress 714, the first curved ends 732*a*, 732*b* of the alignment members 730*a*, 730*b* extend from the second surface 716 of the mattress 714 around one side 718 of the mattress 714, while the second curved ends 733*a*, 73311 extend from the second surface 716 of the mattress 714 around the other side 717 of the mattress 714.

To complete the alignment system and secure the mattress 714 and the alignment members 730*a*, 730*b* to the foundation 712, the alignment system further includes four brackets 750*a*, 750*b*, 751*a*, 751*b* that are each configured to engage the curved ends 732*a*, 732*b*, 733*a*, 733*b* of the alignment members 730*a*, 730*b*. The four brackets 750*a*, 750*b*, 751*a*, 751*b* are also made of a rigid plastic material or other material having a sufficient strength, with the first bracket 750*a* engaging the first curved end 732*a* of the first alignment member 730*a*, the second bracket 751*a* engaging the second curved end 733*a* of the first alignment member 730*a*, the third bracket 750*b* engaging the first curved end 732*b* of the second alignment member 730*b*, and the fourth bracket 751*b* engaging the second curved end 733*b* of the second alignment member 730*b*.

To secure the alignment members 730*a*, 730*b* to the brackets 750*a*, 750*b*, 751*a*, 751*b* and, consequently, the mattress 714 to the foundation 712 of the bed assembly 710, the elongated center segment 734*a* of the alignment member 730*a* defines a first opening in the form of a proximal elongated channel 736*a* and a distal elongated channel 738*a* that are spaced at a predetermined distance and parallel to one another adjacent to the first curved end 732*a* of the alignment member 730*a*, and a second opening in the form of a proximal elongated channel 737*a* and distal elongated channel 739*a* that are spaced at a predetermined distance and parallel to one another adjacent to the second curved end 733*a* of the alignment member 730*a*. Likewise, the elongated center segment 734*b* of the alignment member 730*b* defines a first opening in the form of a proximal elongated channel 736*b* and a distal elongated channel 738*b* that are spaced at a predetermined distance and parallel to one another adjacent to the first curved end 732*b* of the alignment member 730*b*, and a second opening in the form of a proximal elongated channel 737*b* and distal elongated channel 739*b* that are spaced at a predetermined distance and parallel to one another adjacent to the second curved end 733*b* of the alignment member 730*b*. Each of the elongated channels 736*a*, 738*a*, 737*a*, 739*a*, 736*b*, 738*h*, 737*b*, 739*b* further extend in a direction perpendicular to the longitudinal axis of each of the alignment members 734*a*, 734*b*. In this regard, the four brackets 750*a*, 750*b*, 751*a*, 751*b* each include a protuberance in the shape of a ridge 754*a*, 755*a*, 754*b*, 755*b* configured and positioned on each of the four brackets 750*a*, 750*b*, 751*a*, 751*b* such that, upon each bracket 750*a*, 750*b*, 751*a*, 751*b* engaging a corresponding curved end 732*a*, 733*a*, 732*b*, 733*b* of the alignment members 730*a*, 730*b*, each ridge 754*a*, 755*a*, 754*b*, 755*b* extends into a corresponding channel 736*a*, 738*a*, 737*a*, 739*a*, 736*b*, 738*b*, 737*b*, 739*b* to secure the brackets 750*a*, 750*b*, 751*a*, 751*b* to the alignment members 730*a*, 730*b*. Of course, to the extent it may be desired, protuberances having different shapes that correspond to differently-shaped openings can also be used in an exemplary alignment system of the present invention without departing from the spirit and scope of the subject matter described herein.

Throughout this document, various references are mentioned. All such references are incorporated herein by reference.

One of ordinary skill in the art will recognize that additional embodiments or implementations are possible without departing from the teachings of the present invention or the scope of the claims which follow. This detailed description, and particularly the specific details of the exemplary embodiments and implementations disclosed herein, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A cover assembly for a mattress, comprising:

a first cover having a top panel, a bottom panel, a head panel, a foot panel, and two opposing side panels collectively defining a cavity for completely enclosing the mattress;

a second cover having a top surface and a bottom surface, the second cover defining a perimeter, and the second cover positioned over and dimensionally-sized to cover the top panel, an upper half of each opposing side panel, an upper edge of the foot panel, and an upper edge of the head panel of the first cover, such that the second cover extends a distance over the upper half of each opposing side panel that is greater than a distance the second cover extends over the upper edge of the foot panel and the upper edge of the head panel; and a two-way separating zipper comprising two slider bodies connected to a single track extending around the perimeter of the second cover, the two-way separating zipper connecting the second cover to the first cover along the perimeter of the second cover.

2. The cover assembly of claim 1, wherein the second cover includes an amount of phase change material.

3. The cover assembly of claim 1, wherein at least the bottom surface of the second cover includes a water-impervious and vapor-permeable material.

4. The cover assembly of claim 1, wherein the first cover, the second cover, or both the first cover and the second cover are comprised of a textile.

5. The cover assembly of claim 1, wherein the first cover, the second cover, or both the first cover and the second cover are comprised of a flame-retardant material.

6. The cover assembly of claim 1, wherein the second cover includes an amount of a flexible foam positioned between the top surface and the bottom surface.

7. The cover assembly of claim 1, further comprising a charcoal sheet incorporated into the first cover, the second cover, or both the first cover and the second cover.

8. The cover assembly of claim 1, wherein the first cover, the second cover, or both the first cover and the second cover includes an indicia indicative of a characteristic of the mattress.

9. The cover assembly of claim 8, wherein the indicia is a pattern.

10. The cover assembly of claim 8, wherein the indicia is a color.

11. The cover assembly of claim 9, wherein the pattern is positioned on the top surface of the second cover.

12. The cover assembly of claim 8, wherein the indicia is a dot positioned on the top surface of the second cover and having a color, and wherein the head panel or the foot panel of the first cover has a color substantially identical to the color of the dot.

13. The cover assembly of claim 8, wherein the indicia comprises multiple rows of geometric shapes positioned on the head panel or the foot panel of the first cover.

14. The cover assembly of claim 13, wherein the indicia further comprises multiple rows of geometric shapes positioned on the opposing side panels of the first cover.

15. The cover assembly of claim 8, wherein the indicia comprises a plurality of geometric shapes embossed or debossed into the head panel or the foot panel of the first cover, the side panels of the first cover, or both the end panel and side panels of the first cover.

16. The cover assembly of claim 1, wherein the first cover further includes a zipper for securing the first cover around the mattress, the zipper extending around a periphery of the bottom panel.

17. The cover assembly of claim 1, wherein the first cover further includes a brand tag attached to the first cover.

18. The cover assembly of claim 17, wherein the brand tag includes a pocket.

19. A bed assembly comprising:

a mattress having one or more characteristics; and a mattress cover including a first cover having a top panel, a bottom panel, a head panel, a foot panel, and two opposing side panels collectively defining a cavity for completely enclosing the mattress;

a second cover having a top surface and a bottom surface, the second cover defining a perimeter, the second cover positioned over and dimensionally-sized to cover the top panel, an upper half of each opposing side panel, an upper edge of the foot panel, and an upper edge of the head panel of the first cover, such that the second cover extends a distance over the upper half of each opposing side panel that is greater than a distance the second cover extends over the upper edge of the foot panel and the upper edge of the head panel;

an indicia positioned on the second cover, the indicia indicative of at least one of the characteristics of the mattress; and a fastener connecting the second cover to the first cover along the perimeter of the second cover.

20. The bed assembly of claim 19, wherein the mattress is comprised of a flexible foam.

21. The bed assembly of claim 20, wherein the flexible foam is a visco-elastic foam.

22. The bed assembly of claim 20, wherein attachment of the second cover to the first cover results in each side of the mattress being rounded.

23. The bed assembly of claim 19, wherein the mattress includes one or more air bladders.

24. The bed assembly of claim 19, wherein the top surface of the second cover includes the indicia.

25. The bed assembly of claim 19, wherein the indicia is a pattern.

26. The bed assembly of claim 19, wherein the indicia is a color.

27. The bed assembly of claim 19, wherein the head panel or the foot panel also includes the indicia indicative of the characteristic of the mattress.

28. The bed assembly of claim 19, further comprising a foundation, the foundation also including the indicia indicative of the characteristic of the mattress.

29. The bed assembly of claim 19, further comprising a pillow, the pillow also including the indicia indicative of the characteristic of the mattress.

30. The bed assembly of claim 19, wherein the mattress has a firmness and the indicia indicates the firmness of the mattress.

31. The bed assembly of claim 19, wherein the indicia indicates the type of the mattress.

32. The bed assembly of claim 31, wherein the type of the mattress is selected from the group consisting of a mattress comprised of a flexible foam and a mattress comprised of an air bladder surrounded by a layer of flexible foam.

33. The bed assembly of claim 19, wherein the mattress includes a number of foam layers and the indicia indicates the number of foam layers.

* * * * *